US009644452B2

(12) United States Patent
Jacob

(10) Patent No.: US 9,644,452 B2
(45) Date of Patent: May 9, 2017

(54) SEGMENTED SEAT ASSEMBLY

(71) Applicant: SCHLUMBERGER TECHNOLOGY CORPORATION, Sugar Land, TX (US)

(72) Inventor: Gregoire Jacob, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 250 days.

(21) Appl. No.: 14/268,812

(22) Filed: May 2, 2014

(65) Prior Publication Data

US 2015/0101825 A1 Apr. 16, 2015

Related U.S. Application Data

(60) Provisional application No. 61/889,306, filed on Oct. 10, 2013.

(51) Int. Cl.
*E21B 34/14* (2006.01)
*E21B 34/06* (2006.01)

(52) U.S. Cl.
CPC ..... *E21B 34/14* (2013.01); *E21B 34/063* (2013.01)

(58) Field of Classification Search
CPC combination set(s) only.
See application file for complete search history.

(56) References Cited

U.S. PATENT DOCUMENTS 2,315,931 A 4/1943 Burt et al.
3,011,548 A 12/1961 Holt
3,054,415 A 9/1962 Baker et al.
3,263,752 A 8/1966 Conrad
3,269,463 A 8/1966 Page, Jr.
3,684,010 A * 8/1972 Young ..... E21B 33/1291 166/129

(Continued)

FOREIGN PATENT DOCUMENTS

WO 2003095794 11/2003
WO 2004088091 A1 10/2004

(Continued)

OTHER PUBLICATIONS

Lonnes, et al., "Advanced Multizone Stimulation Technology", SPE 95778—SPE Annual Technical Conference and Exhibition, Dallas, Texas, Oct. 9-12, 2005, 7 pages.

(Continued)

*Primary Examiner* — David Andrews
*Assistant Examiner* — Ronald Runyan
(74) *Attorney, Agent, or Firm* — Jeffery R. Peterson

(57) ABSTRACT

An apparatus that is usable with a well includes a first portion and a second portion. The first portion includes a first plurality of segments, and the second portion includes a second plurality of segments. The apparatus is deployable in a tubing string that is installed in the well, and the second plurality of segments is adapted to engage the tubing string and exert a force on the first plurality of segments. The first plurality of segments is adapted to expand to form a seat in the tubing string to receive an untethered object in response to the force, and the second plurality of segments is adapted to be released from the first plurality of segments downhole in the well.

26 Claims, 34 Drawing Sheets

(56) References Cited

U.S. PATENT DOCUMENTS 3,995,692 A 12/1976 Seitz
4,064,937 A 12/1977 Barrington
4,355,686 A 10/1982 Arendt et al.
4,372,384 A 2/1983 Kinney
4,499,951 A 2/1985 Vann
4,729,432 A 3/1988 Helms
4,771,831 A 9/1988 Pringle et al.
4,967,853 A 11/1990 Landry
5,069,280 A 12/1991 McKee et al.
5,183,114 A 2/1993 Mashaw et al.
5,224,044 A 6/1993 Tamura et al.
5,295,393 A 3/1994 Thiercelin
5,333,692 A 8/1994 Baugh et al.
5,526,888 A 6/1996 Gazewood
5,845,712 A 12/1998 Griffith, Jr.
5,921,318 A 7/1999 Ross
5,988,285 A 11/1999 Tucker et al.
6,006,838 A 12/1999 Whiteley et al.
6,059,032 A 5/2000 Jones
6,155,342 A 12/2000 Oneal et al.
6,155,350 A 12/2000 Melenyzer
6,206,095 B1 3/2001 Baugh
6,216,785 B1 4/2001 Achee, Jr. et al.
6,220,356 B1 4/2001 Spikes
6,302,199 B1 10/2001 Hawkins et al.
6,334,486 B1 1/2002 Carmody et al.
6,349,766 B1 2/2002 Bussear et al.
6,371,208 B1 4/2002 Norman et al.
6,443,228 B1 9/2002 Aronstam et al.
6,473,633 B1 * 10/2002 Heil, Jr. ..... A61N 1/0573 600/375
6,543,538 B2 4/2003 Tolman et al.
6,634,429 B2 10/2003 Henderson et al.
6,907,936 B2 6/2005 Fehr et al.
6,997,263 B2 2/2006 Campbell et al.
7,036,582 B2 5/2006 Cook et al.
7,066,265 B2 6/2006 Surjaatmadja
7,093,664 B2 8/2006 Todd et al.
7,096,954 B2 8/2006 Weng et al.
7,108,067 B2 9/2006 Themig et al.
7,114,559 B2 10/2006 Sonnier et al.
7,128,146 B2 10/2006 Baugh et al.
7,134,505 B2 11/2006 Fehr et al.
7,168,494 B2 1/2007 Starr et al.
7,210,533 B2 5/2007 Starr et a
7,322,417 B2 1/2008 Rytlewski et al.
7,325,617 B2 2/2008 Murray
7,350,582 B2 4/2008 McKeachnie et al.
7,353,879 B2 4/2008 Todd et al.
7,377,321 B2 5/2008 Rytlewski
7,387,165 B2 6/2008 Lopez de Cardenas et al.
7,431,091 B2 10/2008 Themig et al.
7,464,764 B2 * 12/2008 Xu ..... E21B 34/14 166/317
7,490,669 B2 2/2009 Walker et al.
7,543,634 B2 6/2009 Fehr et al.
7,543,647 B2 6/2009 Walker
7,549,469 B2 6/2009 Garcia
7,552,779 B2 6/2009 Murray
7,571,765 B2 8/2009 Themig
7,575,062 B2 8/2009 East
7,628,210 B2 12/2009 Avant et al.
7,661,481 B2 2/2010 Todd et al.
7,669,665 B2 3/2010 Millet et al.
7,673,677 B2 3/2010 King et al.
7,748,460 B2 7/2010 Themig et al.
7,775,279 B2 8/2010 Marya et al.
7,798,236 B2 9/2010 McKeachnie et al.
7,832,472 B2 11/2010 Themig
7,891,774 B2 2/2011 Silverbrook
8,211,247 B2 7/2012 Marya et al.
2003/0155118 A1 8/2003 Sonnier et al.
2003/0180094 A1 9/2003 Madison
2004/0020643 A1 2/2004 Thomeer et al.
2004/0035586 A1 2/2004 Gudmestad et al.
2004/0118564 A1 6/2004 Themig et al.
2004/0163820 A1 8/2004 Bishop et al.
2004/0262016 A1 12/2004 Farquhar
2006/0124310 A1 6/2006 Lopez de Cardenas et al.
2006/0131031 A1 6/2006 McKeachnie et al.
2006/0207764 A1 9/2006 Rytlewski
2006/0243455 A1 11/2006 Telfer et al.
2007/0044958 A1 3/2007 Rytlewski et al.
2007/0107908 A1 5/2007 Vaidya et al.
2007/0181224 A1 8/2007 Marya et al.
2007/0181304 A1 8/2007 Rankin et al.
2007/0272413 A1 11/2007 Rytlewski et al.
2007/0284097 A1 12/2007 Swor et al.
2008/0105438 A1 5/2008 Jordan et al.
2008/0210429 A1 9/2008 McMillin et al.
2009/0056934 A1 3/2009 Xu
2009/0159289 A1 * 6/2009 Avant ..... E21B 34/14 166/316
2009/0178808 A1 7/2009 Williamson et al.
2010/0101803 A1 4/2010 Clayton et al.
2010/0101806 A1 4/2010 Millet et al.
2010/0132954 A1 6/2010 Telfer
2010/0209288 A1 8/2010 Marya
2010/0212886 A1 8/2010 Hall et al.
2010/0252280 A1 10/2010 Swor et al.
2010/0282469 A1 11/2010 Richard et al.
2011/0056692 A1 3/2011 Lopez De Cardenas et al.
2011/0127047 A1 6/2011 Themig et al.
2011/0186306 A1 * 8/2011 Marya ..... E21B 33/12 166/386
2011/0192607 A1 8/2011 Hofman et al.
2011/0278010 A1 11/2011 Fehr et al.
2011/0284232 A1 11/2011 Huang
2012/0067583 A1 3/2012 Zimmerman et al.
2012/0085538 A1 4/2012 Guerrero et al.
2012/0145378 A1 6/2012 Frazier
2012/0199341 A1 8/2012 Kellner et al.
2012/0261115 A1 10/2012 Xu
2012/0305236 A1 12/2012 Gouthaman
2013/0062063 A1 3/2013 Baihly et al.
2014/0014371 A1 1/2014 Jacob et al.
2014/0216758 A1 8/2014 Jacob et al.
2014/0216759 A1 8/2014 Jacob et al.

FOREIGN PATENT DOCUMENTS

WO 2009023519 A1 2/2009
WO 2011006173 A2 1/2011
WO 2012174101 A2 12/2012

OTHER PUBLICATIONS

Rytlewski, "Multiple-Layer Completions for Efficient Treatment of Multi-layer Reservoirs", SPE 112476—IADC/SPE Drilling Conference, Orlando, Florida, USA, Mar. 4-6, 2008, 8 pages.

Thomson, et al., "Design and Installation of a Cost-Effective Completion System for Horizontal Chalk Wells Where Vlultiple Zones Require Acid Stimulation", SPE 51177 (a revision of SPE 39150), Offshore Technology Conference, Houston, TX, USA, May 1997.

PCT/US2014/055044, International Search Report and Written Opinion, dated Dec. 23, 2014, 10 pgs.

* cited by examiner

SEGMENTED SEAT ASSEMBLY

CROSS-REFERENCE TO RELATED APPLICATIONS

The present application is related to, and claims priority to, U.S. Provisional Pat. Application No. 61/889,306, filed Oct. 10, 2013, titled, "MODULAR SEAT INSIDE A WELL-BORE," which is incorporated herein by reference in its entirety and for all purposes.

BACKGROUND

For purposes of preparing a well for the production of oil or gas, at least one perforating gun may be deployed into the well via a conveyance mechanism, such as a wireline, slickline or a coiled tubing string. The shaped charges of the perforating gun(s) are fired when the gun(s) are appropriately positioned to perforate a casing of the well and form perforating tunnels into the surrounding formation. Additional operations may be performed in the well to increase the well's permeability, such as well stimulation operations and operations that involve hydraulic fracturing. The above-described perforating and stimulation operations may be performed in multiple stages of the well.

The above-described operations may be performed by actuating one or more downhole tools (perforating guns, sleeve valves, and so forth). A given downhole tool may be actuated using a wide variety of techniques, such dropping a ball into the well sized for a seat of the tool; running another tool into the well on a conveyance mechanism to mechanically shift or inductively communicate with the tool to be actuated; pressurizing a control line; and so forth.

SUMMARY

In an example implementation, an apparatus that is usable with a well includes a first portion and a second portion. The first portion includes a first plurality of segments, and the second portion includes a second plurality of segments. The apparatus is deployable in a tubing string that is installed in the well, and the second plurality of segments is adapted to engage the tubing string and exert a force on the first plurality of segments. The first plurality of segments is adapted to expand to form a seat in the tubing string to receive an untethered object in response to the force, and the second plurality of segments is adapted to be released from the first plurality of segments downhole in the well.

In another example implementation, a technique includes deploying a seat assembly downhole, where the seat assembly includes a top portion having a first plurality of segments and a bottom portion that has a second plurality of segments. The technique includes setting the seat assembly so that the top portion of the seat assembly forms an annular seat. The technique further includes landing an untethered object on the annular seat and releasing a bottom portion of the seat assembly while the untethered object is landed on the annular seat.

In yet another example implementation, a system includes a segmented seat assembly that is deployable downhole and has a top set of segments and a bottom set of segments. The bottom set of segments aid in the radial expansion of the seat assembly, and the top set of segments form a ring shaped seat upon full radial expansion. The system includes an untethered object that is deployable downhole, where the untethered object is catchable by the ring shaped seat. The bottom set of segments dissolve at a rate higher than that of the top set of segments.

Advantages and other features will become apparent from the following drawing, description and claims.

DETAILED DESCRIPTION

Figure 1:
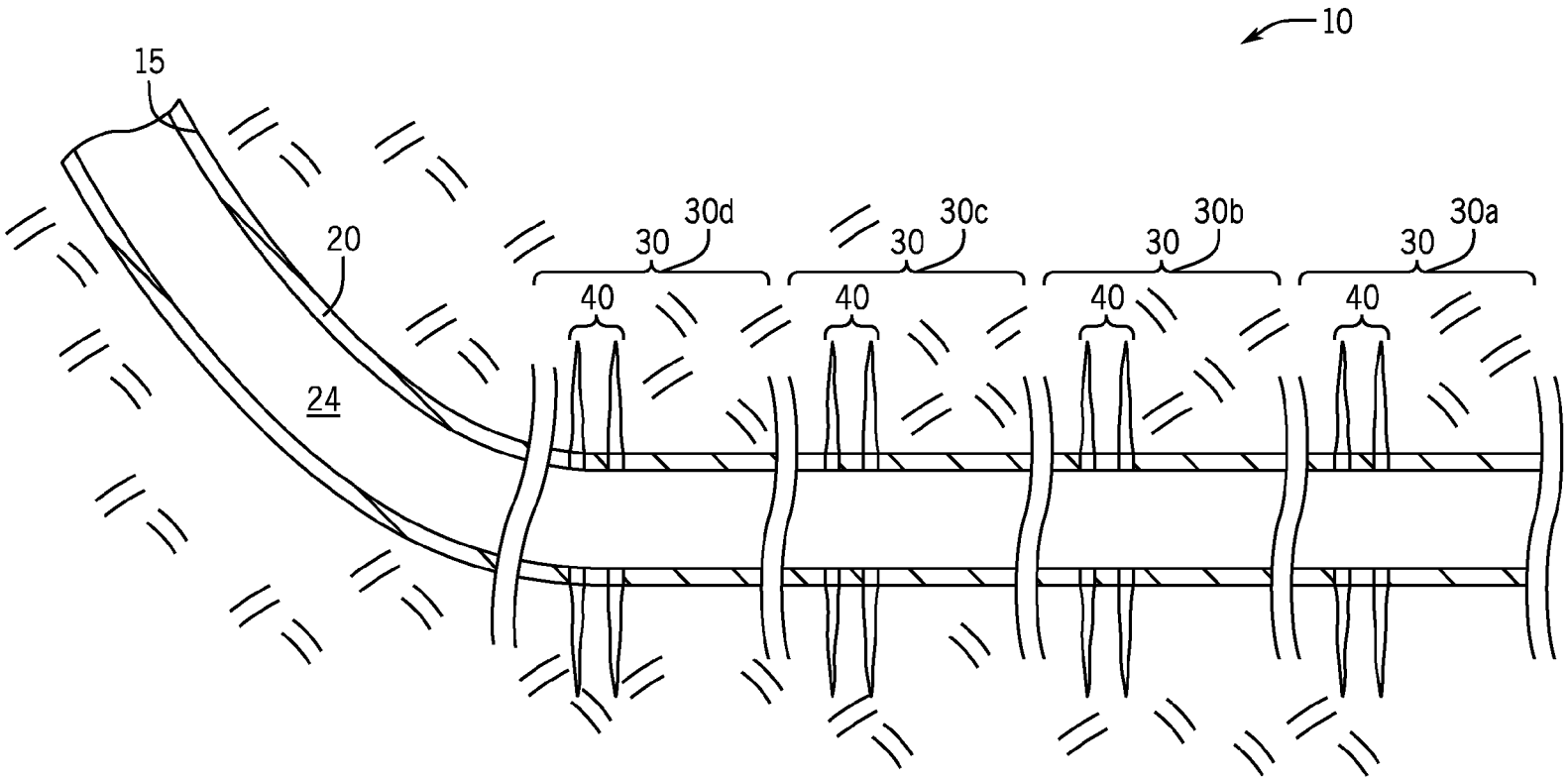
FIGS. 1 and 2 schematic diagrams of wells according to example implementations.

In general, systems and techniques are disclosed herein to deploy and use a segmented seat assembly in a well for purposes of performing a downhole operation. As an example, the seat assembly may be run downhole in the well and secured to a tubular member (a casing string, a deformable tubular member, a fracturing sleeve valve, a tubing inside an open hole completion, and so forth, as examples) at a desired location in which the downhole operation is to be performed. The downhole operation may be any of a number of operations (stimulation operations, perforating operations, and so forth) that use a ring, or seat, for purposes of receiving a member (an activation ball, a dart, a bar, a tool surface, and so forth) to form a fluid barrier in the well.

In general, the segmented seat assembly is an expandable, segmented assembly, which is formed from arcuate segments. The segmented seat assembly has two states: a collapsed, or unexpanded state, which allows the seat assembly to have a smaller cross-section for purposes of running the assembly downhole; and a radially expanded state in which the seat assembly forms a continuously extending ring that is constructed to receive an object to form the downhole fluid barrier.

In accordance with example implementations, the segmented seat assembly is constructed to form a ring to receive, or catch, an untethered object, which is deployed in the well. In this context, an "untethered object" refers to an object that is communicated downhole through a passageway (a tubing string passageway, for example) of the well along at least part of its path without the use of a conveyance line (a slickline, a wireline, a coiled tubing string and so forth). As examples, the untethered object may be a ball (or sphere), a dart or a bar. The untethered object may also be a tool that is pumped downhole.

In accordance with example implementations, the segmented ring assembly has two portions, or "subassemblies": an upper subassembly that is constructed to radially expand in the well, or be "set," to form a continuous ring, or seat, that receives an object for purposes of forming a fluid barrier; and a lower subassembly that is constructed to radially expand downhole in the well and serve as an aid to set the upper subassembly. Moreover, after the first subassembly has been expanded and set to form the continuous seat, in accordance with example implementations, the lower subassembly is designed to be released, thereby leaving the upper subassembly (with the seat) retained to the tubing string.

In this manner, as further described herein, in accordance with example implementations, the upper and lower subassemblies may be formed from materials that degrade at different rates: the upper subassembly may be constructed to degrade at a relatively slower rate; and the lower subassembly may be constructed to degrade at a relatively higher rate. As a more specific example, the lower subassembly may be formed from a material that causes the lower subassembly to dissolve in a matter of one to two hours in the well environment as the lower subassembly's function is completed after the upper subassembly has been secured in place; and the upper subassembly may be constructed to retain its integrity for weeks, days, or even "permanent" to allow sufficient time to form the fluid barrier, in accordance with an example implementation.

As a more specific example, in accordance with some implementations, a well 10 includes a wellbore 15, which traverses one or more hydrocarbon-bearing formations. As an example, the wellbore 15 may be lined, or supported, by a tubing string 20, as depicted in FIG. 1. The tubing string 20 may be cemented to the wellbore 15 (such wellbores are typically referred to as "cased hole" wellbores); or the tubing string 20 may be secured to the surrounding formation(s) by packers (such wellbores typically are referred to as "open hole" wellbores). In general, the wellbore 15 may extend through multiple zones, or stages 30 (four example stages 30*a*, 30*b*, 30*c* and 30*d*, being depicted in FIG. 1, as examples), of the well 10.

It is noted that although FIG. 1 and other figures disclosed herein depict a lateral wellbore, the techniques and systems that are disclosed herein may likewise be applied to vertical wellbores. Moreover, in accordance with some implementations, the well 10 may contain multiple wellbores, which contain tubing strings that are similar to the illustrated tubing string 20 of FIG. 1. The well 10 may be a subsea well or may be a terrestrial well, depending on the particular implementations. Additionally, the well 10 may be an injection well or may be a production well. Thus, many implementations are contemplated, which are within the scope of the appended claims.

The downhole operations may be performed in the stages 30 in a particular directional order, in accordance with example implementations. For example, in accordance with some implementations, downhole operations may be conducted in a direction from a toe end of the wellbore to a heel end of the wellbore 15. In further implementations, these downhole operations may be connected from the heel end to the toe end of the wellbore 15. In accordance with further example implementations, the operations may be performed in no particular order, or sequence.

FIG. 1 depicts that fluid communication with the surrounding hydrocarbon formation(s) has been enhanced through sets 40 of perforation tunnels that, for this example, are formed in each stage 30 and extend through the tubing string 20. It is noted that each stage 30 may have multiple sets of such perforation tunnels 40. Although perforation tunnels 40 are depicted in FIG. 1, it is understood that other techniques may be used to establish/enhance fluid communication with the surrounding formation (s), as the fluid communication may be established using, for example, a jetting tool that communicates an abrasive slurry to perforate the tubing string wall; opening sleeve valves of the tubing string 20; and so forth.

Figure 2:
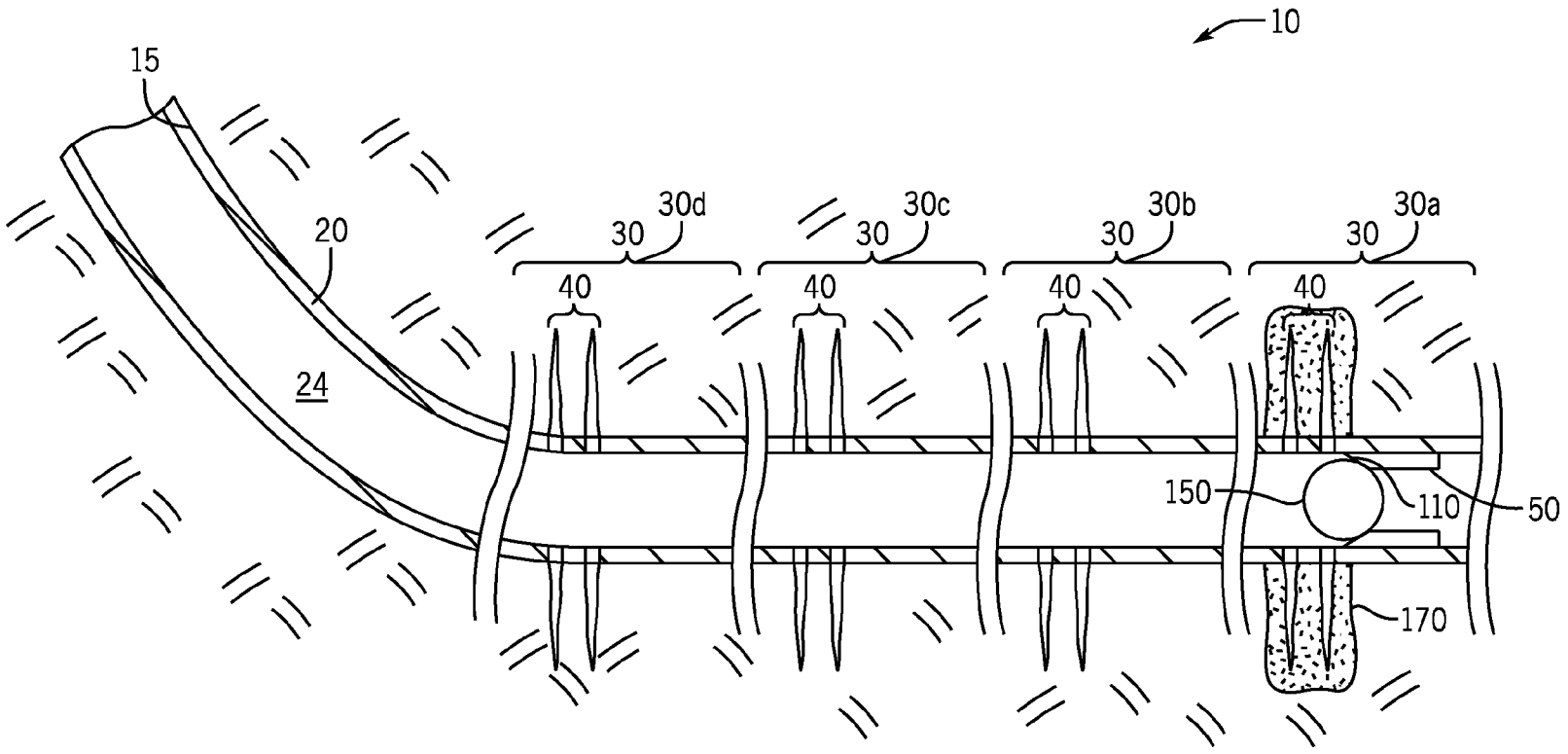

Referring to FIG. 2 in conjunction with FIG. 1, as an example, a stimulation operation may be performed in the stage 30*a* by deploying an expandable, segmented seat assembly 50 (herein called the "seat assembly") into the tubing string 20 on a setting tool (as further disclosed herein) in a contracted state of the assembly 50; expanding the seat assembly 50 downhole in the well; and securing the seat assembly 50 to the tubing string 20 at a targeted location in the stage 30*a*. For the example implementation that is depicted in FIG. 2, the seat assembly 50 is installed in the tubing string 20 near the bottom, or downhole end, of the stage 30*a*. Once installed inside the tubing string 20, the combination of the seat assembly 50 and an untethered object (here, an activation ball 150) form a fluid tight obstruction, or barrier, to divert fluid in the tubing string 20 uphole of the barrier. Thus, for the example implementation of FIG. 2, the fluid barrier may be used to direct fracture fluid (pumped into the tubing string 20 from the Earth surface) into the stage 30*a*.

Figure 3A:
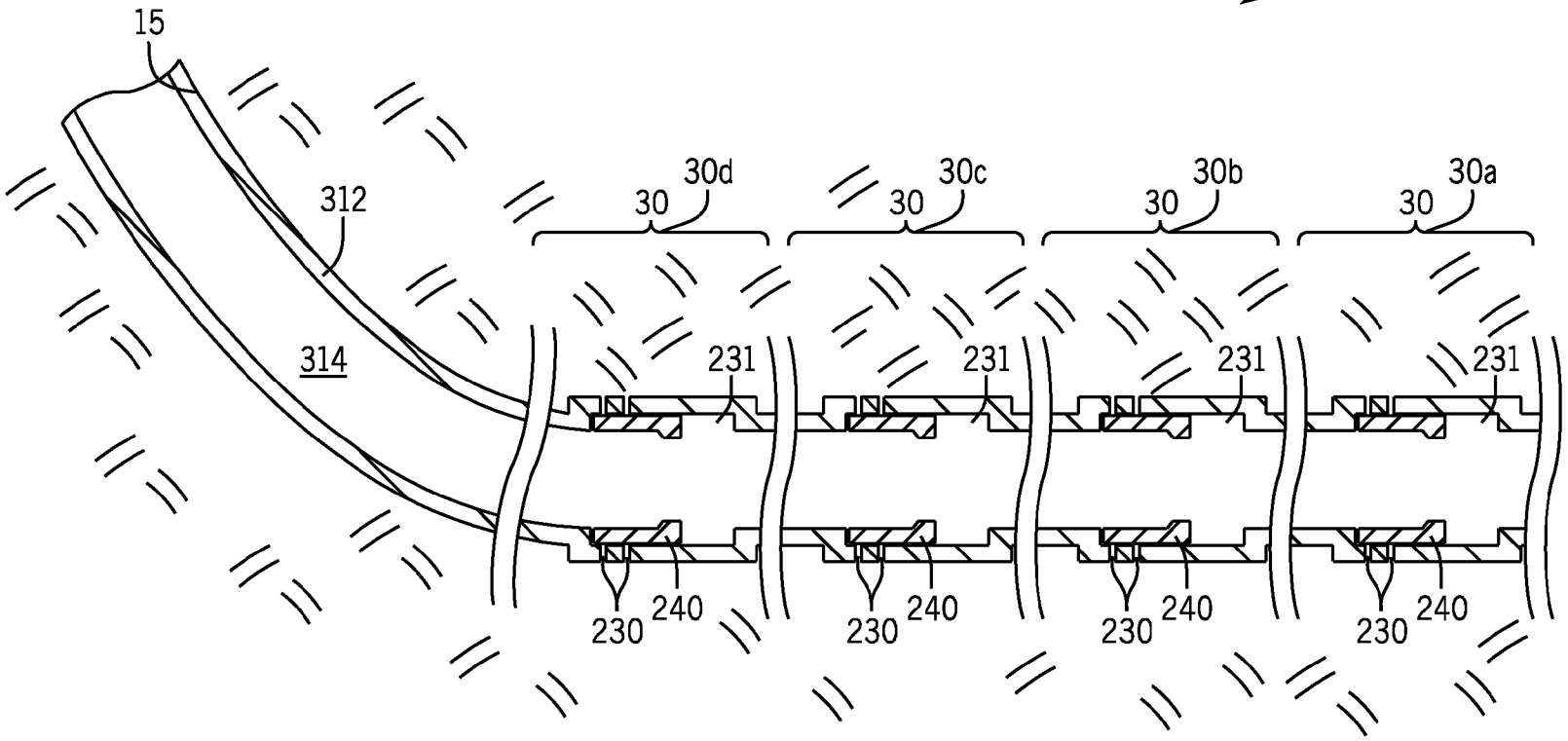
FIGS. 3A, 3B, 3C, 3D and 3E are schematic diagrams of a well illustrating use of an expandable, segmented seat assembly to operate a sleeve valve according to an example implementation.

FIG. 3A depicts an example tubing string 312 of a well 300, which has a central passageway 314 and extends through associated stages 30*a*, 30*b*, 30*c* and 30*d* of the well 300. Each stage 30 has an associated sleeve 240, which resides in a recess 231 of the tubing string 312 and has been previously installed in the stage 30. For the state of the well 300 depicted in FIG. 3A, the sleeve 240 is installed in the well in a closed state, or an uphill position and therefore covers radial ports 230 in the tubing string wall. As an example, each stage 30 may be associated with a given set of radial ports 230, so that by communicating an activation ball (or other untethered object) downhole inside the passageway 314 of the tubing string 312 and landing the ball in a seat of a seat assembly 237 (see FIG. 3B), a corresponding fluid barrier may be formed to divert fluid through the associate set of radial ports 230.

Figure 3B:
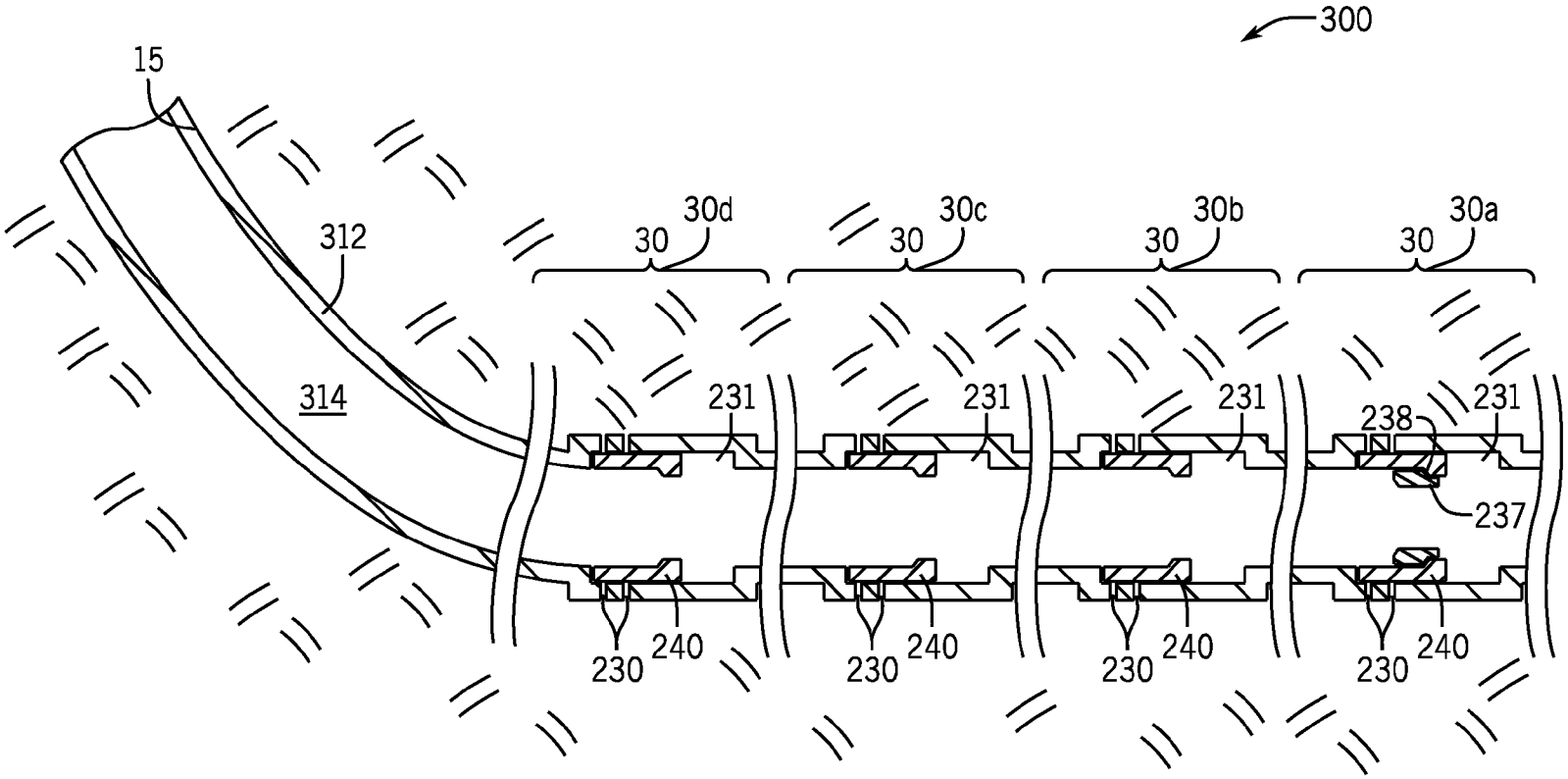

Referring to FIG. 3B, as shown, the seat assembly 237 has been deployed (attached, anchored, swaged) to the sleeve 240. The connection between the seat assembly 237 and the sleeve 240 may be facilitated using a shoulder 238 on the sleeve 240, which engages a corresponding shoulder of the seat assembly 237. However, in accordance with further implementations, other connection methods may be used, such as recess on the sleeve 240, a direct anchoring with the seat assembly 237, and so forth.

It is noted that the seat assemblies 237 may be installed one by one after the stimulation of each stage 30 (as discussed further below); or multiple seat assemblies 237 may be installed in a single trip into the well 300. Therefore, the seat, or inner catching diameter of the seat assembly 237, for the different assemblies 237, may have different dimensions, such as inner dimensions that are relatively smaller downhole and progressively become larger moving in an uphill direction. This allows the use of differently-sized activation balls to land on the seat assemblies 237 without further downhole intervention and therefore achieve continuous pumping treatment of multiple stages 30.

Figure 3C:
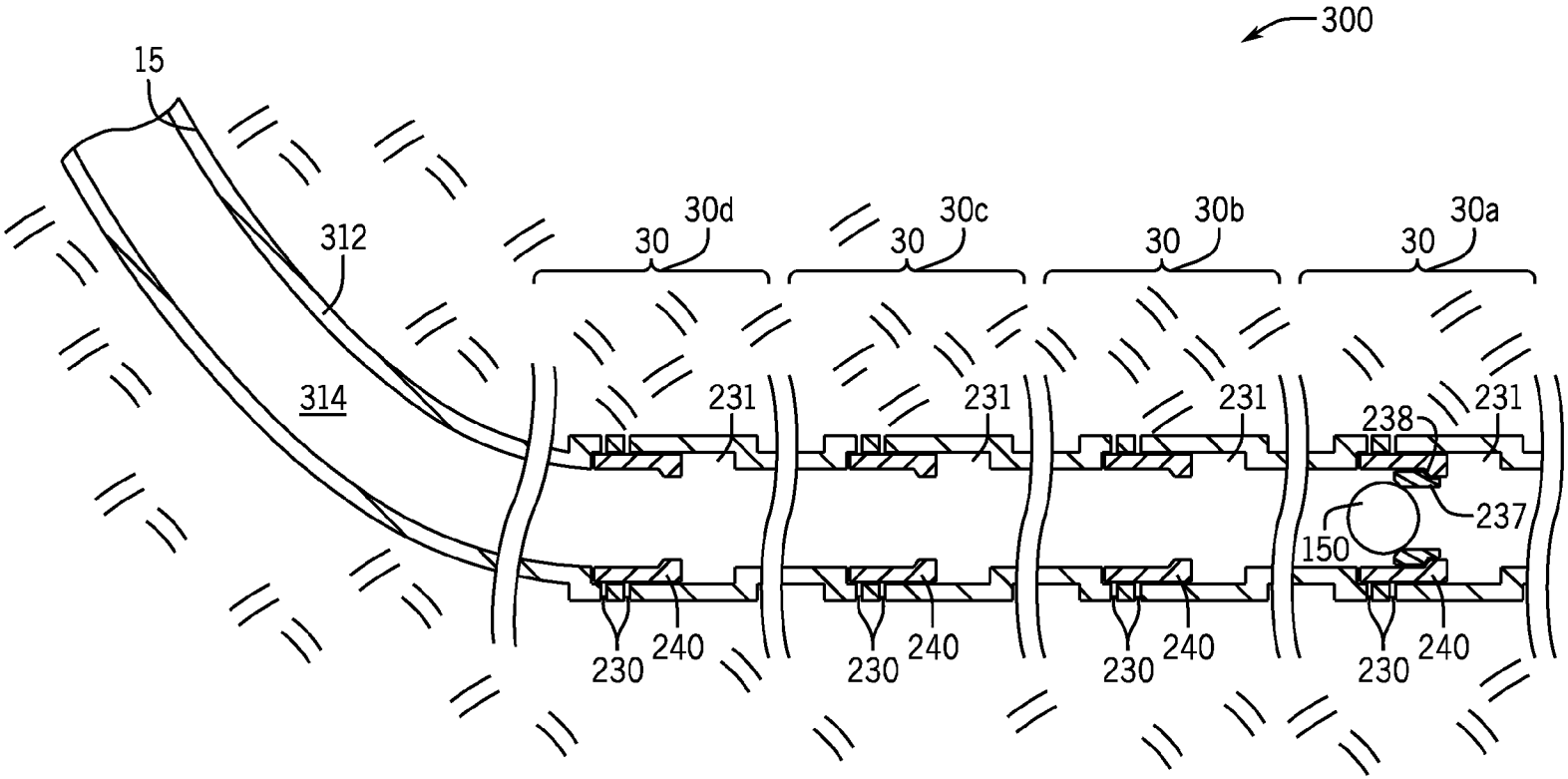

Referring to FIG. 3C, this figure depicts the landing of the activation ball 150 on the seat assembly 237 of the stage 30*a*. Thus, at this point, the activation ball 150 has been retained, or caught, by the seat assembly 237.

Figure 3D:
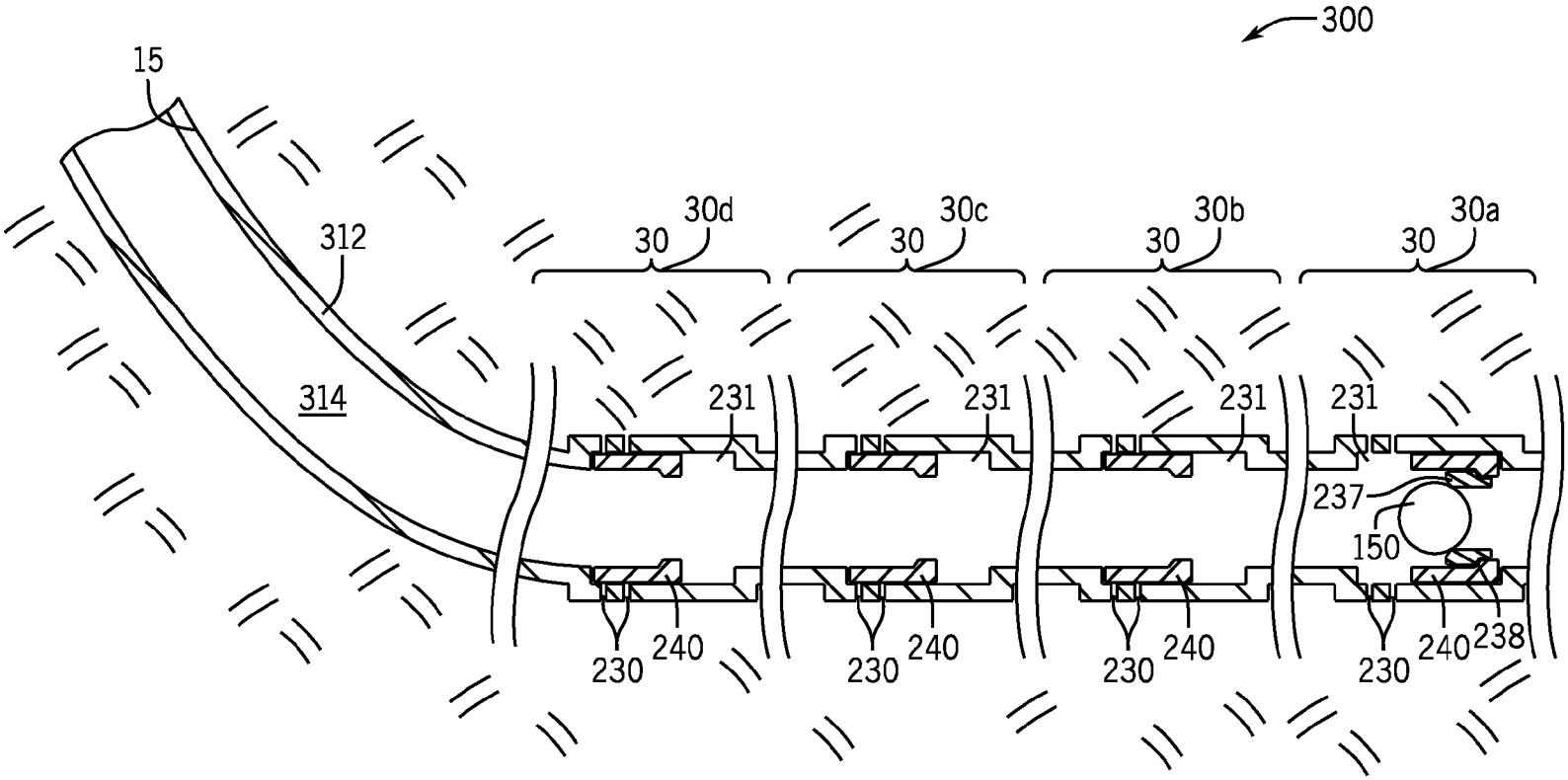

Referring to FIG. 3D, due to the force that is exerted by the activation ball 150, due to either through the momentum of the ball 150 or the pressure differential created by the ball 150, the sleeve 240 as well as the seat assembly 237 is shifted downhole, revealing the radial ports 230. In this position, a pumping treatment (the pumping of a fracturing fluid, for example) may be performed in the stage 30*a*.

Figure 3E:
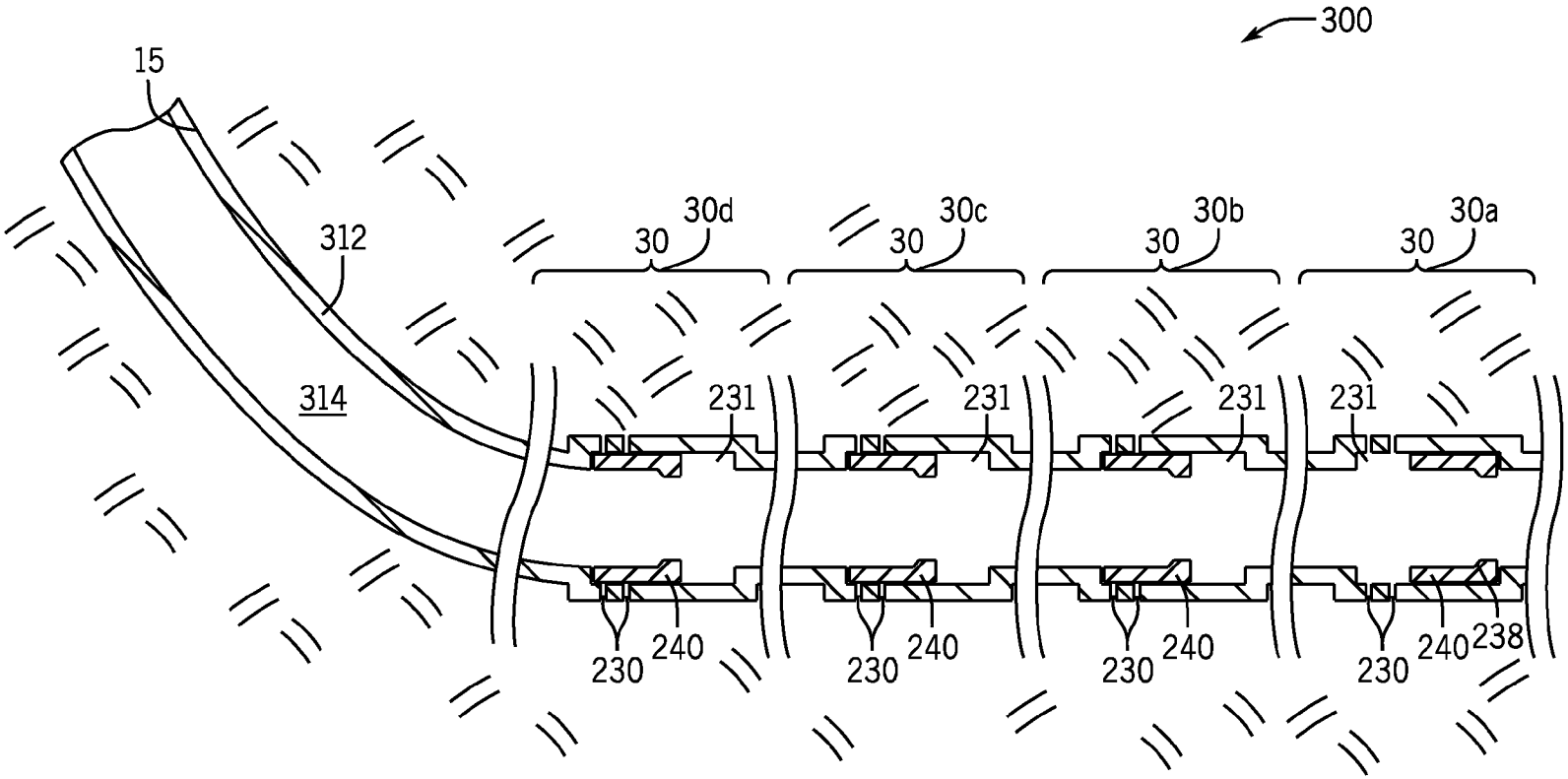

FIG. 3E depicts the stage 30*a* with the sleeve 240 in the opened position and with the seat assembly 237 and activation ball 150 being dissolved, as further discussed below.

Figure 4:
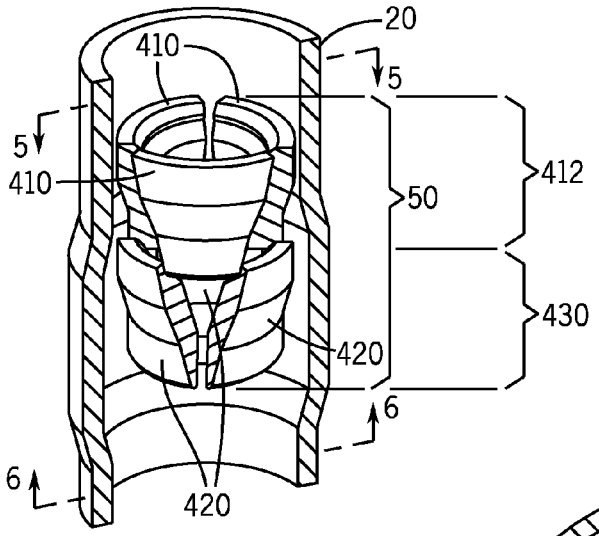
FIG. 4 is a schematic view illustrating an expandable, segmented seat assembly in a contracted state and inside a tubing string according to an example implementation.
Figure 5:
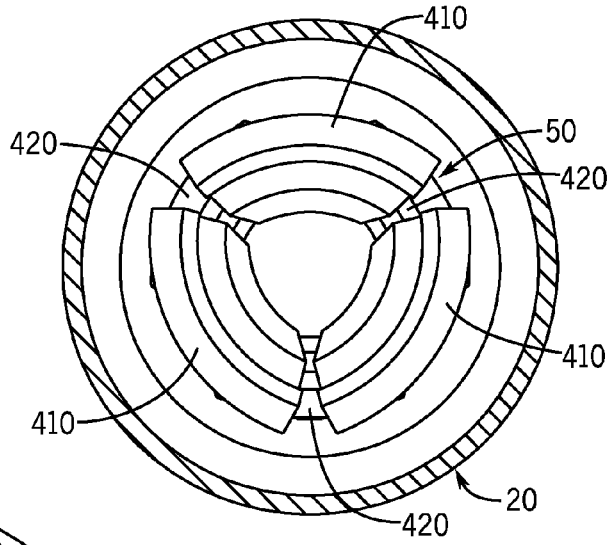
FIG. 5 is a cross-sectional view taken along line 5-5 of FIG. 4 according to an example implementation.
Figure 6:
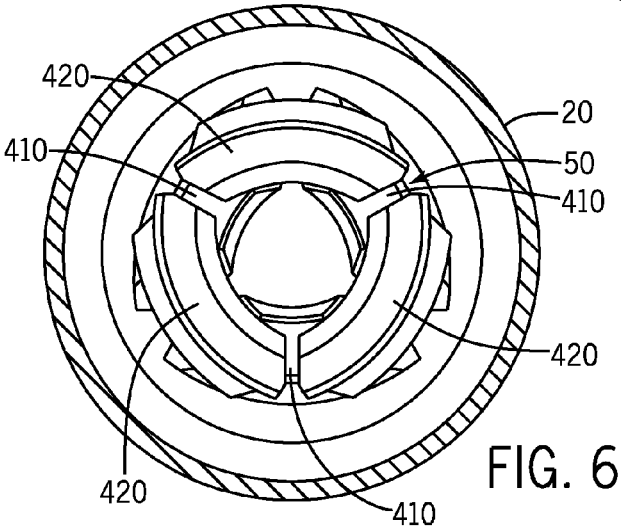
FIG. 6 is a cross-sectional view taken along line 6-6 of FIG. 4 according to an example implementation.

As an example, FIG. 4 is a perspective of the seat assembly 50, and FIGS. 5 and 6 illustrate cross-sectional views of the seat assembly 50 of FIG. 4, in accordance with an example implementation. Referring to FIG. 4, this figure depicts the seat assembly 50 in a contracted state, i.e., in a radially collapsed state, which facilitates travel of the seat assembly 50 downhole to its final position. The seat assembly, 50 for this example implementation, has two sets of arcuate segments: three upper segments 410; and three lower segments 420. In the contracted state, the segments 410 and 420 are radially contracted and are longitudinally, or axially, expanded into two layers 412 and 430.

Figure 7:
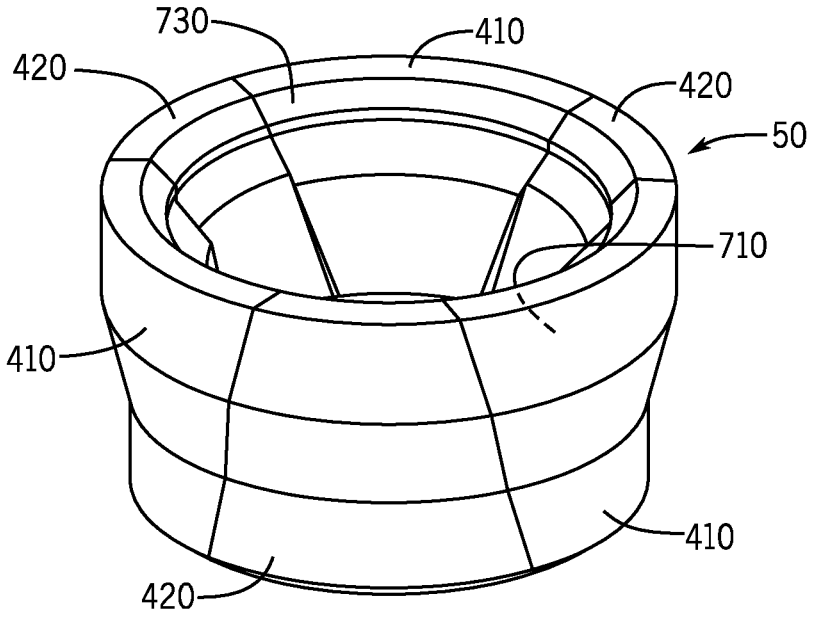
FIG. 7 is a perspective view of the seat assembly in an expanded state according to an example implementation.

The upper segment 410 is, in general, a curved wedge that has a radius of curvature about the longitudinal axis of the seat assembly 50 and is larger at its top end than at its bottom end; and the lower segment 420 is, in general, an curved wedge that has the same radius of curvature about the longitudinal axis (as the upper segment) and is larger at its bottom end than at its top end. Due to the relative complementary profiles of the segments 410 and 420, when the seat assembly 50 expands (i.e., when the segments 410 and 420 radially expand and the segments 410 and 420 axially contract), the two layers 412 and 430 longitudinally, or axially, compress into a single layer of segments such that each upper segment 410 is complimentarily received between two lower segments 420, and vice versa, as depicted in FIG. 7. In its expanded state, the seat assembly 50 forms a tubular member having a seat that is sized to catch an appropriately-sized object that is deployed in the tubing string 20 for purposes of forming a fluid barrier.

Figure 8:
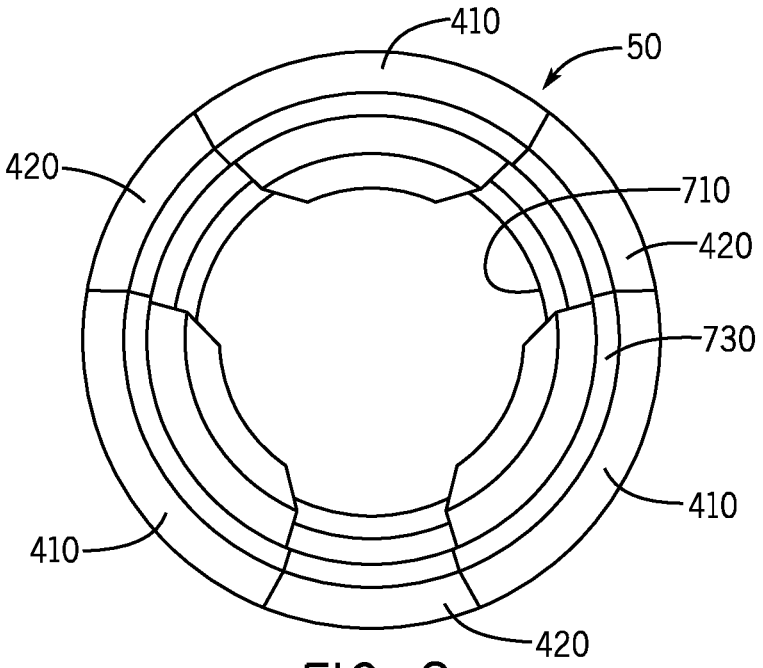
FIG. 8 is a top view of the seat assembly of FIG. 7 according to an example implementation.

More specifically, an upper curved surface of each of the segments 410 and 420 forms a corresponding section of a seat ring 730 (i.e., the "seat") of the seat assembly 50 when the assembly 50 is in its expanded state. As depicted in FIG. 8, in its expanded state, the seat ring 730 of the seat assembly 50 defines an opening 710, which is appropriately sized to control which smaller size objects to pass through the seat ring 730 and which larger size objects are caught by the seat ring 730.

Figure 9:
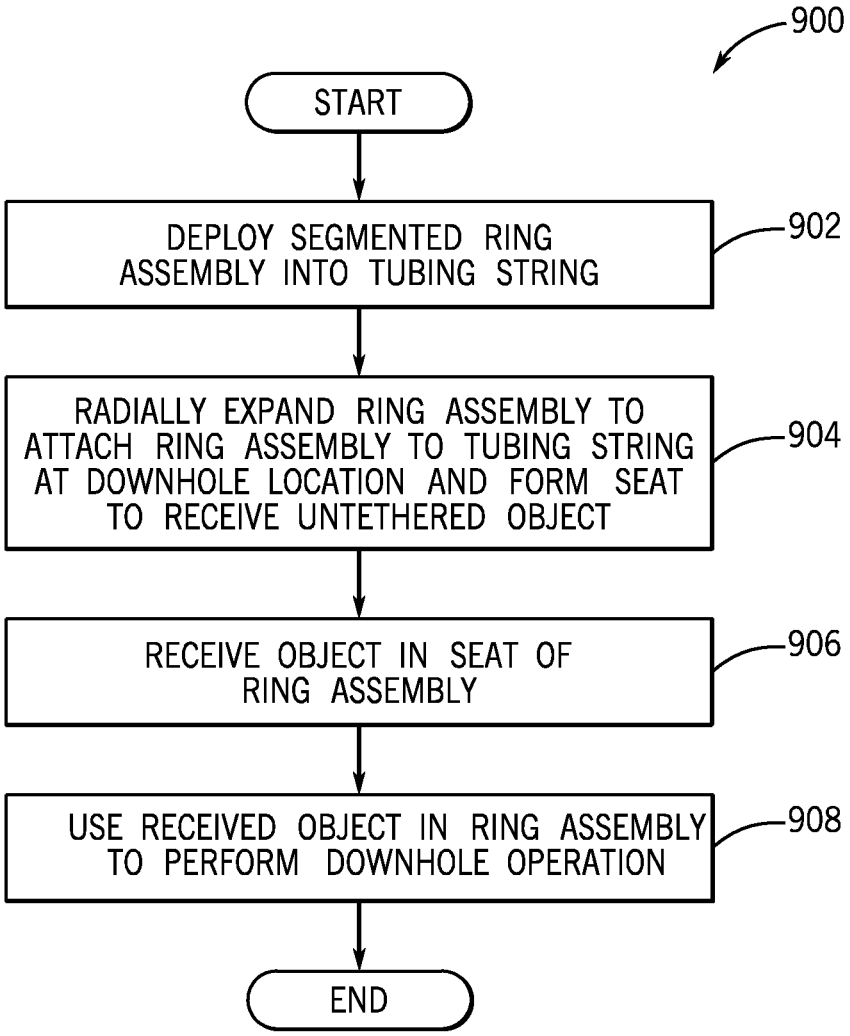
FIG. 9 is a flow diagram depicting a technique to deploy and use an expandable seat assembly according to an example implementation.

Thus, referring to FIG. 9, in accordance with example, implementations, a technique 900 includes deploying (block 902) a segmented seat assembly into a tubing string and radially expanding (block 904) the seat assembly to attach the seat assembly to a tubing string at a downhole location and form a seat to receive an untethered object. Pursuant to the technique 900, an object is received in a seat of the seat assembly and used (block 908) to perform a downhole operation.

Figure 10:
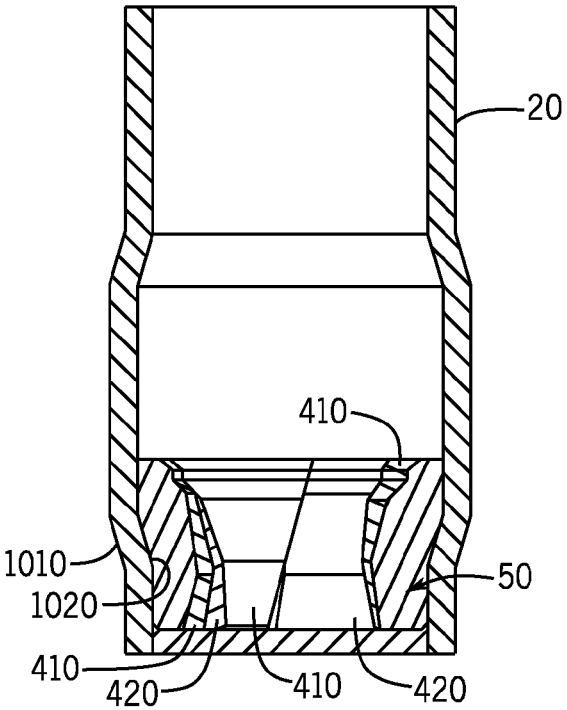
FIG. 10 is a cross-sectional view of the seat assembly in an expanded state inside a tubing string according to an example implementation.

The seat assembly 50 may attach to the tubing string in numerous different ways, depending on the particular implementation. For example, FIG. 10 depicts an example tubing string 20 that contains a narrowed seat profile 1020, which complements an outer profile of the seat assembly 50 in its expanded state. In this regard, as depicted in FIG. 10, the segments 410 and 420 contain corresponding outer profiles 1010 that engage the tubing profile 1010 to catch the seat assembly 50 on the profile 1020. In accordance with example implementations, at its profile 1020, the tubing string 50 has a sufficiently small cross-section, or diameter for purposes of forming frictional contact to allow the setting tool to transition the seat assembly 50 to the expanded state, as further disclosed herein.

Figure 11:
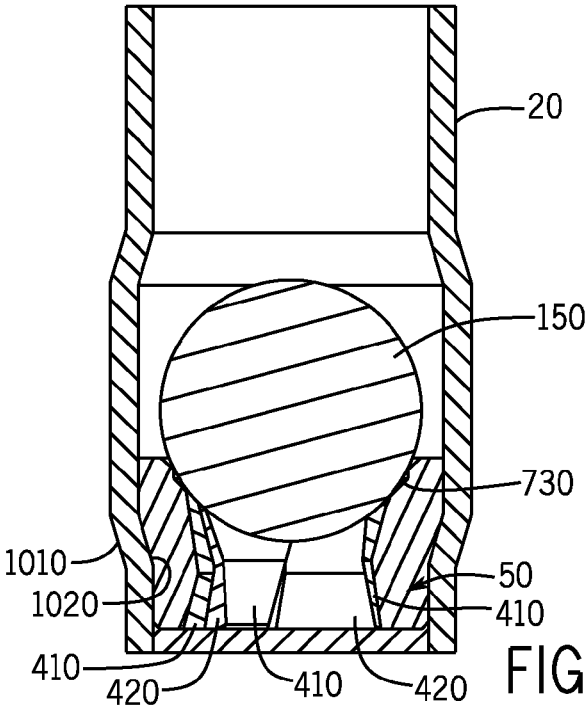
FIG. 11 is a cross-sectional view of the seat assembly in an expanded state inside a tubing string and in receipt of an activation ball according to an example implementation.

Moreover, in accordance with example implementations, the full radial expansion and actual contraction of the seat assembly 50 may be enhanced by the reception of the untethered object 150. As shown in FIG. 11, the untethered object 150 has a diameter that is sized appropriately to land in the seat ring 730 and further expand the seat assembly 50.

Further systems and techniques to run the seat assembly 50 downhole and secure the seat assembly 50 in place downhole are further discussed below.

Figure 12:
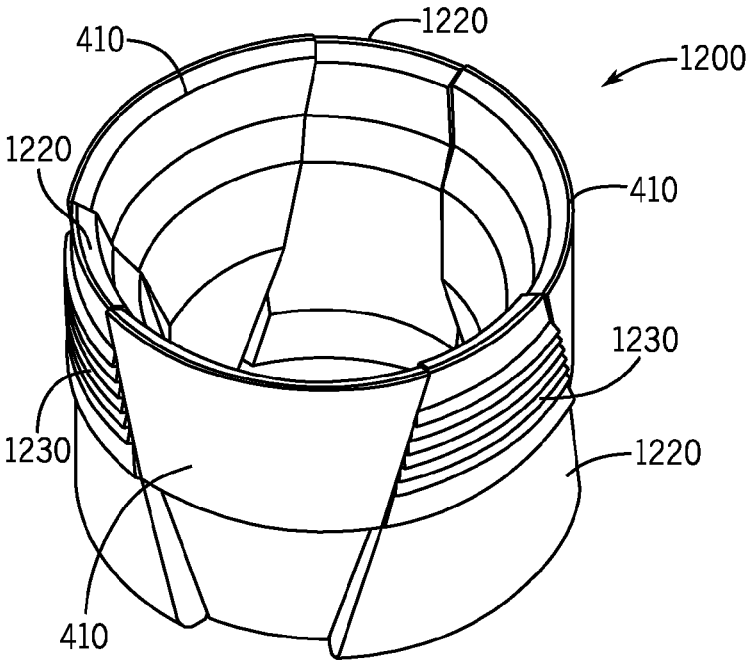
FIGS. 12 and 13 are perspective views of expandable seat assemblies according to further example implementations.
Figure 13:
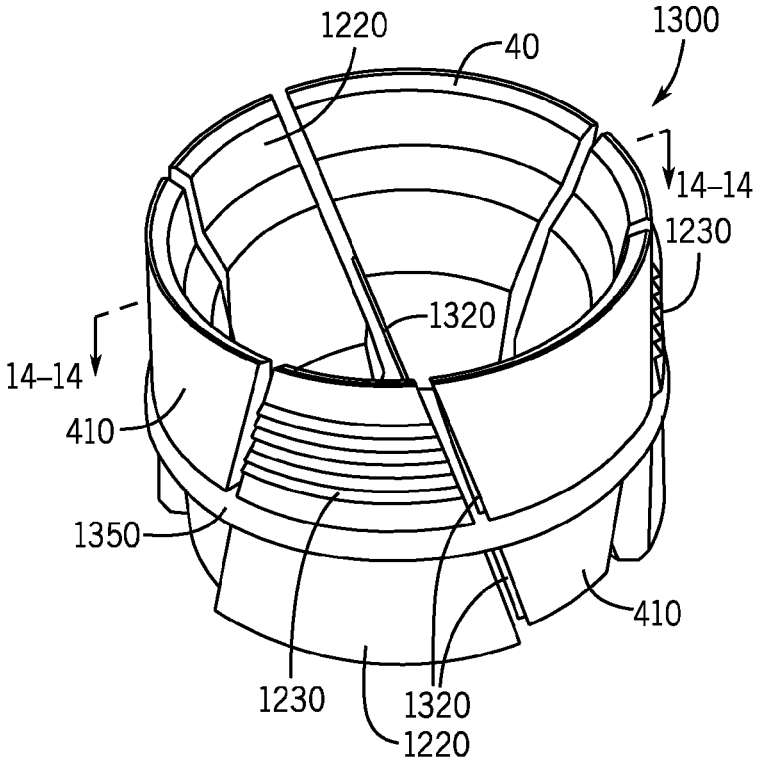

Other implementations are contemplated and are within the scope of the appended claims. For example, FIG. 12 depicts a seat assembly 1200 that has similar elements to the seat assembly 50, with similar reference numerals being used to depict similar elements. Unlike the seat assembly 50, the seat assembly 1200 has segments 1220 that replace the segments 420. The segments 1220 are, in general, curved and wedge-shaped sections similar to the segments 420. However, unlike the segments 420, the segments 1220 have anchors, or slips 1230, that are disposed on the outer surface of the segments 1220 for purposes of anchoring the seat assembly 1200 to the tubing string wall when the segments 1220 radially expand. As another example, FIG. 13 depicts a seat assembly 1300 that that has similar elements to the seat assembly 1200, with similar reference numerals being used to depict similar elements.

Figure 14:
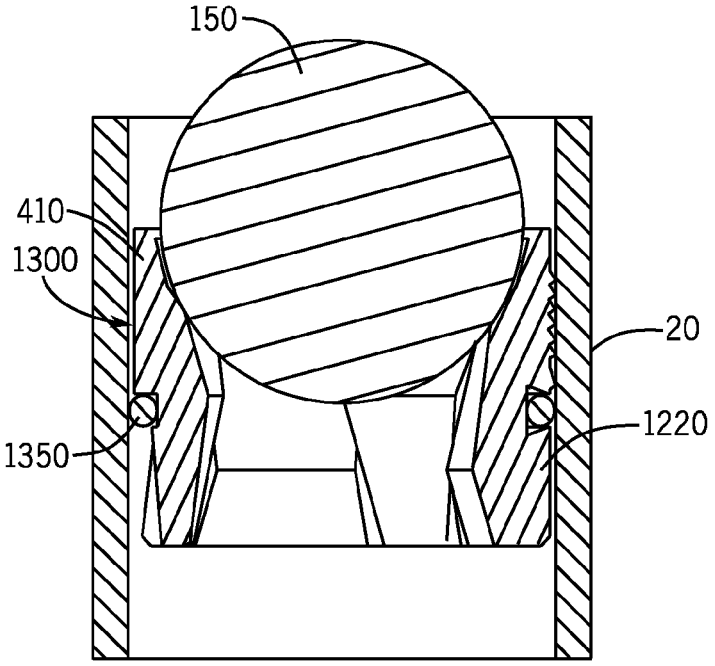
FIG. 14 is a cross-sectional view of the seat assembly taken along line 14-14 of FIG. 13 when the seat assembly is in receipt of an activation ball according to an example implementation.

Unlike the seat assembly 1200, the seat assembly 1300 contains fluid seals. In this manner, in accordance with example implementations, the seat assembly 1300 has fluid seals 1320 that are disposed between the axially extending edges of the segments 410 and 1220. Moreover, the seat assembly 1300 includes a peripherally extending seal element 1350 (an o-ring, for example), which extends about the periphery of the segments 410 and 1220 to form a fluid seal between the outer surface of the expanded seat assembly 1300 and the inner surface of the tubing string wall. More specifically, FIG. 14 depicts a cross-sectional view of the seat assembly 1300 of FIG. 13 in the radially expanded state when receiving an untethered object 150.

In accordance with some implementations, the collective outer profile of the segments 410 and 420 may be contoured in a manner to form an object that engages a seat assembly that is disposed further downhole. In this manner, after the seat assembly performs its intended function by catching an untethered object, the seat assembly may then be transitioned (via a downhole tool, for example) back into its radially contracted state so that the seat assembly may travel further downhole and serves as an untethered object to perform another downhole operation.

As a more specific example, in accordance with further implementations, a segmented seat assembly 2700 of FIG. 27 may be used. In general, the segmented seat assembly 2700 has upper seat segments 410 and lower seat segments 420, similar to the seat segments discussed above. The segmented seat assembly 2700 includes a lower contoured cap 2710, which is profiled (having, for example, beveled features, as depicted at reference number 2714) for purposes of forming a contoured profile to engage a seat that is positioned below the segmented seat assembly 2700 after the segmented seat assembly 2700 is released. As an example, in accordance with some implementations, the cap 2710 may be attached to the lower seat segments 420.

Figure 15:
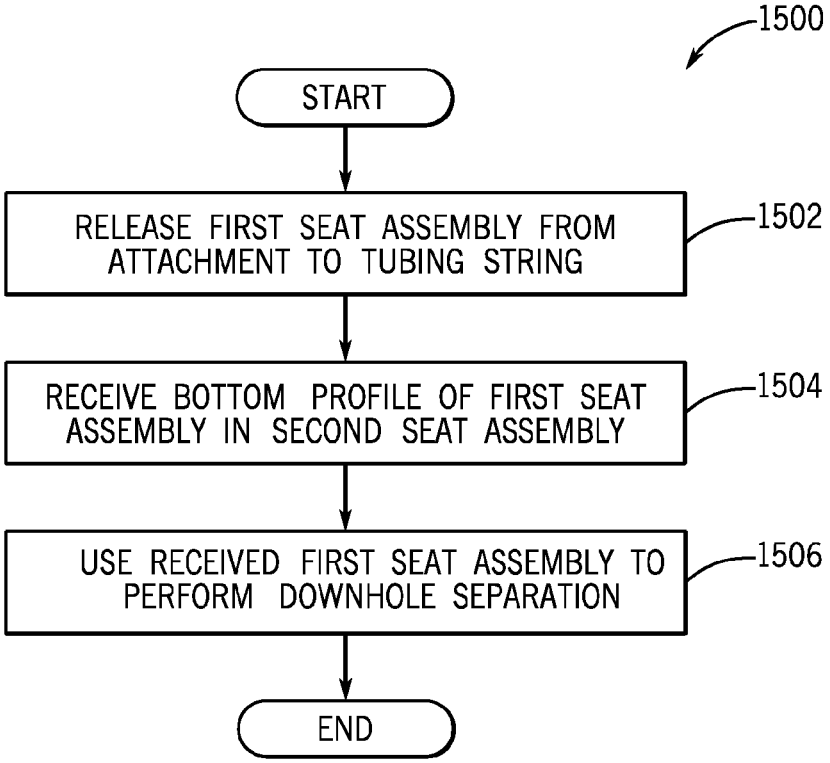
FIG. 15 is a flow diagram depicting a technique to deploy and use an expandable seat assembly according to a further example implementation.

Thus, referring to FIG. 15, in accordance with an example implementation, a technique 1500 includes releasing (block 1502) a first seat assembly from being attached to a tubing string and receiving (block 1504) a bottom profile of the first seat assembly in a second seat assembly. Pursuant to the technique 1500, the received first seat assembly may then be used, pursuant to block 1506, to perform a downhole operation.

Figure 16A:
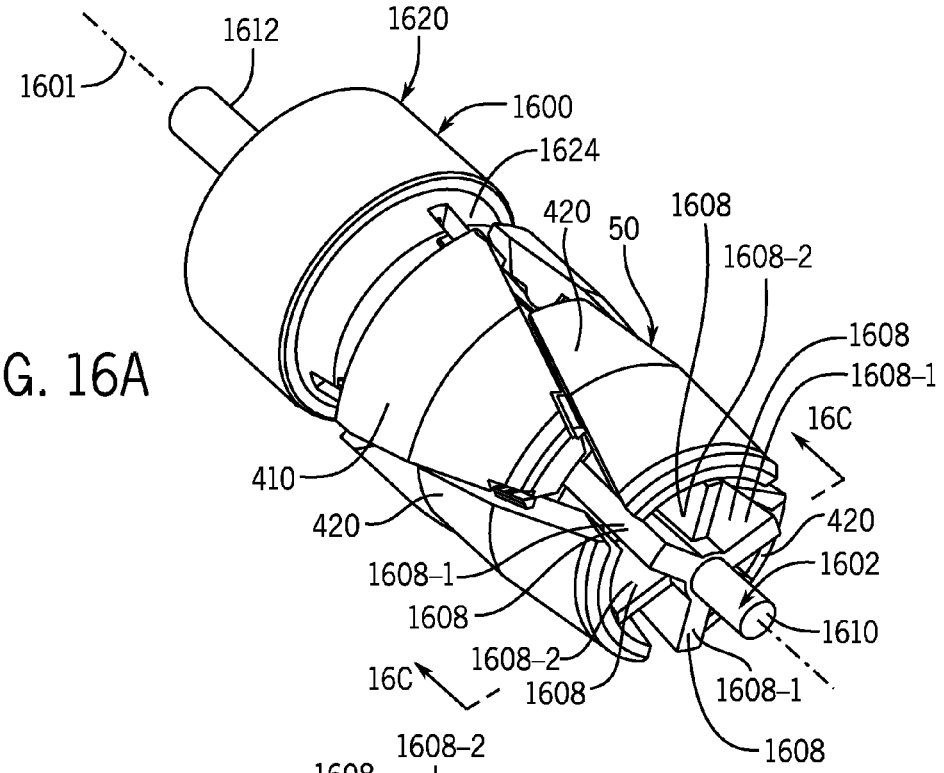
FIG. 16A is a perspective view of a seat assembly setting tool and a segmented seat assembly according to an example implementation.

Referring to FIG. 16A, in accordance with an example implementation, a setting tool 1600 may be used to transition the seat assembly 50 between its contracted and expanded states. As further disclosed herein, the setting tool 1600 includes components that move relative to each other to expand or contract the seat assembly 50: a rod 1602 and a mandrel 1620, which generally circumscribes the rod 1602. The relative motion between the rod 1602 and the mandrel 1620 causes surfaces of the mandrel 1620 and rod 1602 to contact the upper 410 and lower 420 segments of the seat assembly 50 for purposes of radially expanding the segments 410 and 420 and longitudinally contracting the segments into a single layer to form the continuous seat, as described above.

As depicted in FIG. 16A, the rod 1602 and mandrel 1620 are generally concentric with a longitudinal axis 1601 and extend along the longitudinal axis 1601. An upper end 1612 of the rod 1602 may be attached to a conveyance line (a coiled tubing string, for example), and a bottom end 1610 of the rod 1602 may be free or attached to a downhole tool or string, depending on the particular implementation.

Figure 16B:
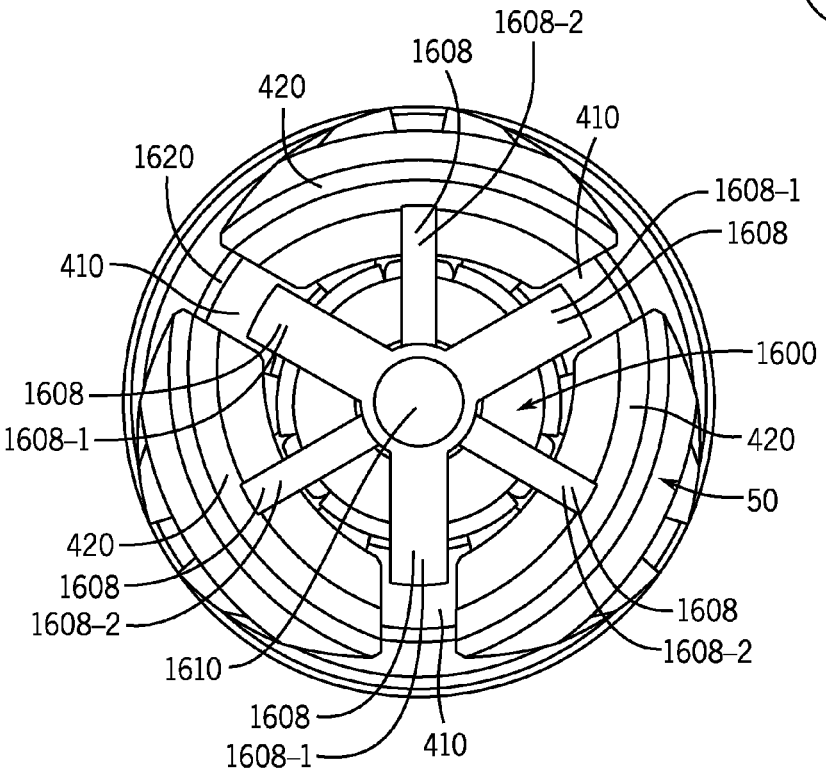
FIG. 16B is a bottom view of the seat assembly setting tool and seat assembly of FIG. 16A according to an example implementation.

Referring to FIG. 16B in conjunction with FIG. 16A, in accordance with example implementations, in general, the rod 1602 contains radially extending vanes 1608 for purposes of contacting inner surfaces of the seat assembly segments 410 and 420: vanes 1608-1 to contact the upper segments 410; and vanes 1608-2 to contact the lower segments 420. For the specific example implementation that is illustrated in FIGS. 16A and 16B, the setting tool 1600 includes six vanes 1608, i.e., three vanes 1608-1 contacting for the upper segments 410 and three vanes 1608-2 for contacting the lower segments 420. Moreover, as shown, the vanes 1608 may be equally distributed around the longitudinal axis 1601 of the setting tool 1600, in accordance with example implementations. Although the examples depicted herein show two layers of three segments, it is noted that an infinite possibility of combinations with additional layers or with a number of segments per layer may be used (combinations of anywhere from 2 to 20 for the layers and segments, as examples) and contemplated and are within the scope of the appended claims.

Figure 16C:
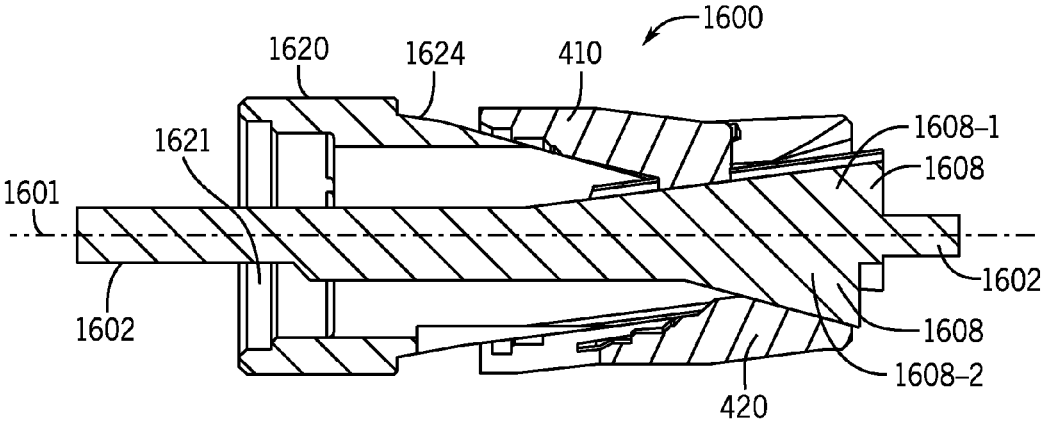
FIG. 16C is a cross-sectional view taken along line 16C-16C of FIG. 16A according to an example implementation.

Referring to FIG. 16C, relative motion of the rod 1602 relative to the mandrel 1620 longitudinally compresses the segments 410 and 420 along the longitudinal axis 1601, as well as radially expands the segments 410 and 420. This occurs due to the contact between the segments 410 and 420 with the inclined faces of the vanes 1608, such as the illustrated incline faces of the vanes 1608-1 and 1608-2 contacting inner surfaces of the segments 410 and 420, as depicted in FIG. 16C.

Figure 17:
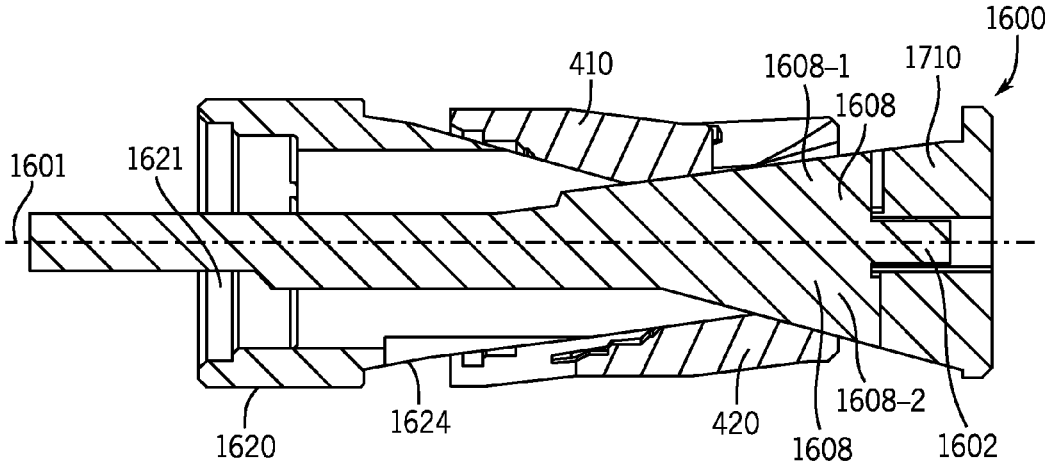
FIG. 17 is a cross-sectional view of a seat assembly setting tool and a segmented seat assembly according to a further example implementation.

FIG. 17 depicts a cross-sectional view for the seat assembly setting tool 1600 according to a further implementation. In general, for this implementation, the setting tool 1600 includes a bottom compression member 1710 that is disposed at the lower end of the rod 1602. As further disclosed below, the compression member 1710 aids in exerting a radial setting force on the segments 410 and 420 and may be released from the setting tool 1600 and left downhole with the expanded seat assembly (after the remainder of the setting tool 1600 is retrieved from the well) to form a retaining device for the seat assembly, as further discussed below.

Figure 18A:
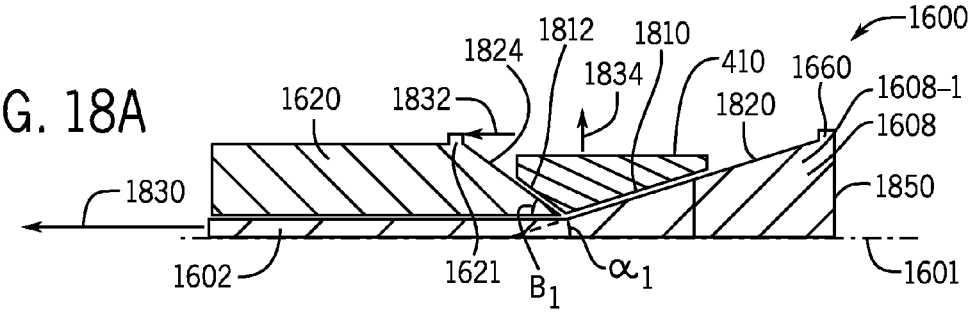
FIGS. 18A, 18B, 18C, 18D, 18E and 18F are cross-sectional views illustrating use of the setting tool to expand an upper segment of the seat assembly to transition the seat assembly to an expanded state according to an example implementation.

FIG. 18A depicts a partial cross-sectional view of the setting tool 1600, according to an example implementation, for purposes of illustrating forces that the tool 1600 exerts on the lower segment 410. It is noted that FIG. 18*a* depicts one half of the cross-section of the setting tool 1600 about the tool's longitudinal axis 1601, as can be appreciated by the skilled artisan.

Referring to FIG. 18A, an inclined, or sloped, surface 1820 of the vane 1608-1 and a sloped surface 1824 of the mandrel 1620 act on the upper segment 410 as illustrated in FIG. 18A. In particular, the sloped surface 1820 of the vane 1608-1 forms an angle $\alpha 1$ (with respect to the longitudinal axis 1601), which contacts an opposing sloped surface 1810 of the segment 410. Moreover, the sloped surface 1824 of the mandrel 1620 is inclined at an angle $\beta 1$ with respect to the longitudinal axis 1601. The sloped surface 1824 of the mandrel 1820, in turn, contacts an opposing sloped surface 1812 of the upper segment 410. The surfaces 1820 and 1824 have respective surface normals, which, in general, are pointed in opposite directions along the longitudinal axis 1601. Therefore, by relative movement of the rod 1602 in the illustrated uphole direction 1830, the surfaces 1820 and 1824 of the setting tool 1600 produce a net outward radial force 1834 on the segment 410, which tends to radially expand the upper segment 410. Moreover, the relative movement of the rod 1602 and mandrel 1620 produces a force 1832 that causes the segment 410 to longitudinally translate to a position to compress the segments 410 and 420 into a single layer.

Figure 19A:
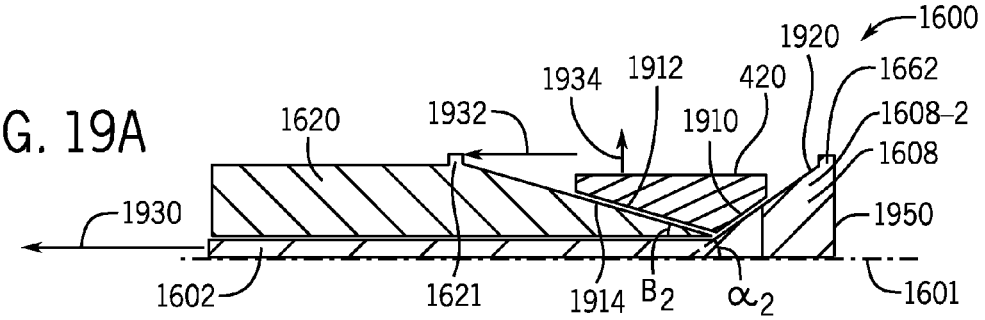
FIGS. 19A, 19B, 19C, 19D, 19E and 19F are cross-sectional views illustrating use of the setting tool to expand a lower segment of the seat assembly to transition the seat assembly to the expanded state according to an example implementation.

Referring to FIG. 19A, for the lower segment 420, the vane 1608-2 of the rod 1602 has a sloped surface 1920, which contacts a corresponding sloped surface 1910 of the lower segment 420; and the mandrel 1620 has a sloped surface 1914 that contacts a corresponding opposing sloped surface 1912 of the lower segment 420. As depicted in FIG. 19A, the slope surfaces 1914 and 1920 having opposing surface normals, which cause the relative movement between the rod 1602 and mandrel 1620 to produce a net radially outward force 1934 on the lower segment 410. Moreover, movement of the rod 1602 relative to the mandrel 1620 produces a longitudinal force 1932 to longitudinally translate the lower segment 420 into a position to compress the seat assembly 50 into a single layer. As shown in FIG. 19A, the sloped surfaces 1920 and 1914 have associated angles called "$\beta 2$" and "$\alpha 2$" with respect to the longitudinal axis 1601.

In accordance with example implementations, the $\alpha 1$ and $\alpha 2$ angles may be the same; and the $\beta 1$ and $\beta 2$ angles may be same. However, different angles may be chosen (i.e., the $\alpha 1$ and $\alpha 2$ angles may be different, as well as the $\beta 1$ and $\beta 2$ angles, for example), depending on the particular implementation. Having different slope angles involves adjusting the thicknesses and lengths of the segments of the seat assembly 50, depending on the purpose to be achieved. For example, by adjusting the different slope angles, the seat assembly 50 and corresponding setting tool may be designed so that all of the segments of the seat assembly are at the same height when the seat assembly 50 is fully expanded or a specific offset. Moreover, the choice of the angles may be used to select whether the segments of the seat assembly finish in an external circular shape or with specific radial offsets.

The relationship of the $\alpha$ angles (i.e., the $\alpha 1$ and $\alpha 2$ angles) relative to the $\beta$ angles (i.e., the $\beta 1$ and $\beta 2$ angles) may be varied, depending on the particular implementation. For example, in accordance with some implementations, the $\alpha$ angles may be less than the $\beta$ angles. As a more specific example, in accordance with some implementations, the $\beta$ angles may be in a range from one and one half times the $\alpha$ angle to ten times the $\alpha$ angle, but any ratio between the angles may be selected, depending on the particular implementation. In this regard, choices involving different angular relationships may depend on such factors as the axial displacement of the rod 1602, decisions regarding adapting the radial and/or axial displacement of the different layers of the elements of the seat assembly 50; adapting friction forces present in the setting tool and/or seat assembly 50; and so forth.

Figure 18B:
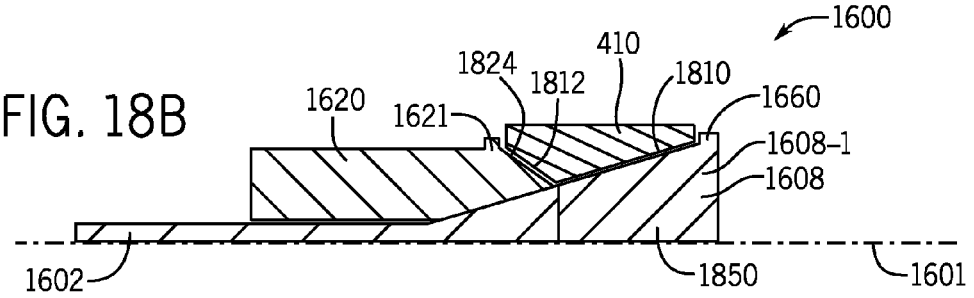

FIG. 18B depicts further movement (relative to FIG. 18A) of the rod 1602 with respect to the upper segment 410 mandrel 1620, resulting in full radial expansion of the upper seat segment 410; and FIG. 18B also depicts stop shoulders 1621 and 1660 that may be used on the mandrel 1620 and rod 1602, in accordance with some example implementations. In this manner, for the state of the setting that is depicted in FIG. 18A, relative travel between the rod 1602 and the mandrel 1620 is halted, or stopped, due to the upper end of the upper seat segment 410 contacting a stop shoulder 1621 of the mandrel 1620 and a lower stop shoulder 1660 of the vane 1608-2 contacting the lower end of segment 410. Likewise, FIG. 19B illustrates full radial expansion of the lower seat segment 420, which occurs when relative travel between the rod 1602 and the mandrel 1620 is halted due to the segment 420 resting between a stop shoulder 1625 of the mandrel 1620 and a stop shoulder 1662 of the vane 1608-2.

Figure 19B:
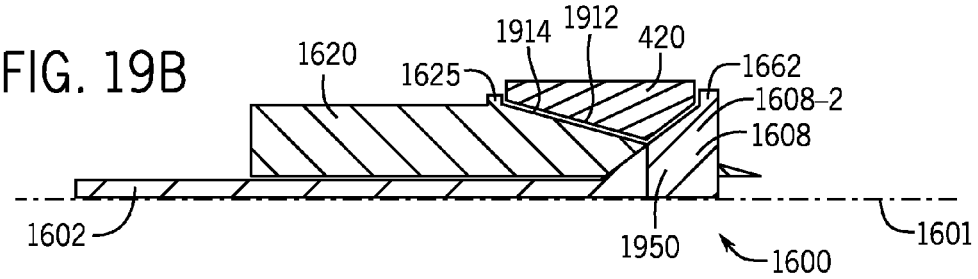

For the setting tool 1600 that is depicted in FIGS. 18A-19B, the tool 1600 includes a bottom compression member that is attached to the lower end of the mandrel 1620 and has corresponding member parts 1850 (contacting the segments 410) and 1950 (contacting the segments 420). In example with example implementations, compression members 1850 and 1950 may be the same part but are depicted in the figures at two different cross-sections for clarity. Thus, as shown in FIGS. 18A and 18B, the vane 1608-1 contains a compression member part 1850; and the vane 1608-2 depicted in FIGS. 19A and 19B depicts a compression member part 1950. In accordance with further implementations disclosed herein, the mandrel of a setting tool may not include such an extension. Moreover, although specific implementations are disclosed herein in which the rod of the setting tool moves with respect to the mandrel, in further implementations, the mandrel may move with respect to the rod. Thus, many variations are contemplated, which are within the scope of the appended claims.

Figure 18C:
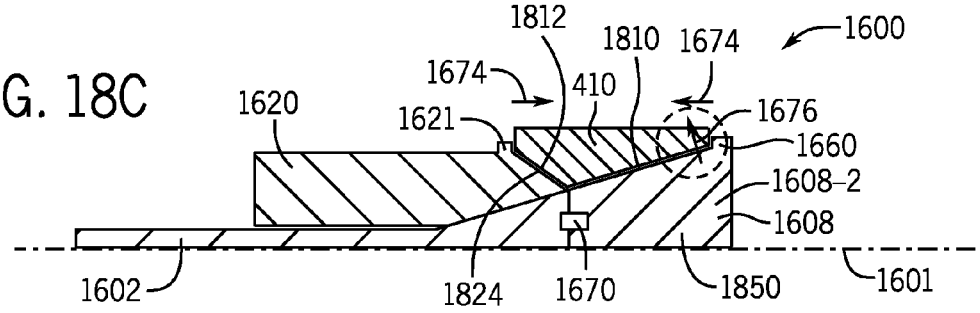
Figure 19C:
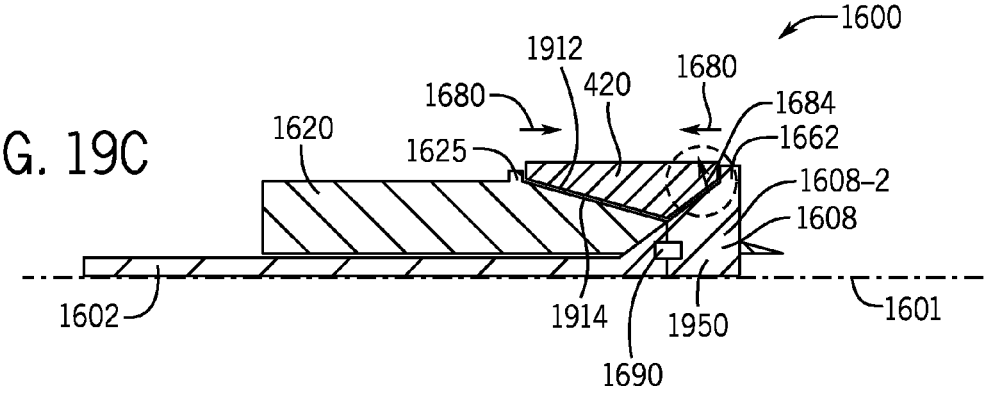

In accordance with further implementations, the bottom compression member of the rod 1602 may be attached to the remaining portion of the rod using one or more shear devices. In this manner, FIG. 18C depicts the compression member part 1850 being attached to the rest of the vane 1608-1 using a shear device 1670, such as a shear screw, for example. Likewise, FIG. 19C depicts the compression member part 1950 being attached to the remainder of the vane 1608-2 using a corresponding shear device 1690. The use of the compression member, along with the shear device(s) allows the setting tool to leave the compression member downhole to, in conjunction with the seat assembly 50, form a permanently-set seat in the well.

More specifically, the force that is available from the setting tool 1600 actuating the rod longitudinally and the force-dependent linkage that is provided by the shear device, provide a precise level of force transmitted to the compression member. This force, in turn, is transmitted to the segments of the seat assembly 50 before the compression member separates from the rod 1602. The compression member therefore becomes part of the seat assembly 50 and is released at the end of the setting process to expand the seat assembly 40. Depending on the particular implementation, the compression piece may be attached to the segments or may be a separate piece secured by one or more shear devices.

Thus, as illustrated in FIGS. 18C and 19B, through the use of the compression pieces, additional force, i.e., additional longitudinal forces 1674 (FIG. 18C) and 1680 (FIG. 19C); or additional radial forces 1676 (FIG. 18C) or 1684 (FIG. 19C); or a combination of both, may be applied to the seat assembly 50 to aid in expanding the seat assembly.

The above-described forces may be transmitted to a self-locking feature and/or to an anti-return feature. These features may be located, for example, on the side faces of the seat assembly's segments and/or between a portion of all segments and the compression piece.

In accordance with some implementations, self-locking features may be formed from tongue and groove connections, which use longitudinally shallow angles (angles between three and ten degrees, for example) to obtain a self-locking imbrication between the parts due to contact friction.

Anti-return features may be imparted, in accordance with example implementations, using, for example, a ratchet system, which may be added on the external faces of a tongue and groove configuration between the opposing pieces. The ratchet system may, in accordance with example implementations, contain spring blades in front of anchoring teeth. The anti-return features may also be incorporated between the segment (such as segment 410) and the compression member, such as compression member 1850. Thus, many variations are contemplated, which are within the scope of the appended claims.

FIGS. 18D, 19D, 18E, 19E, 18F and 19F depict using of the bottom compression member along with the shear devices, in accordance with an example implementation.

Figure 18D:
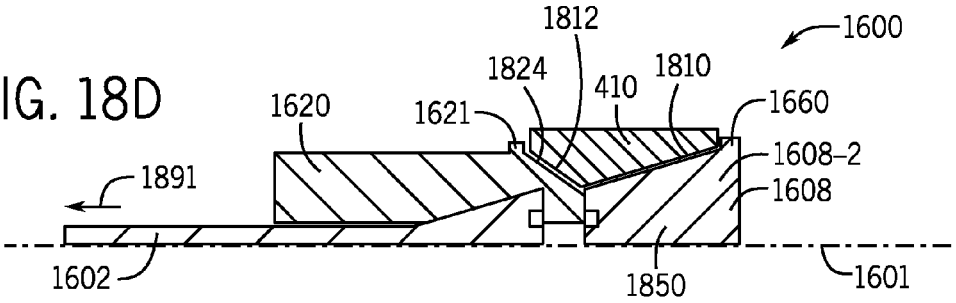
Figure 19D:
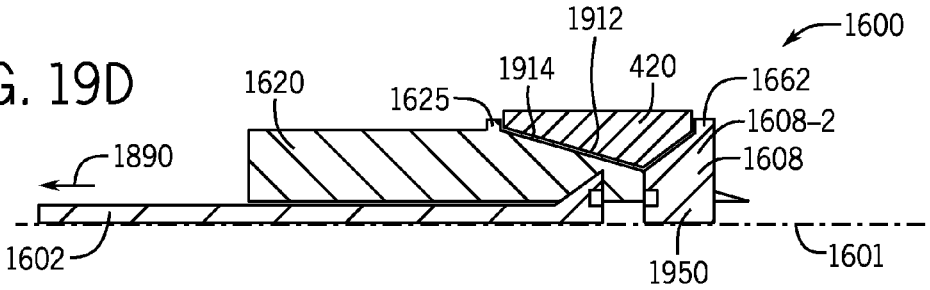
Figure 18E:
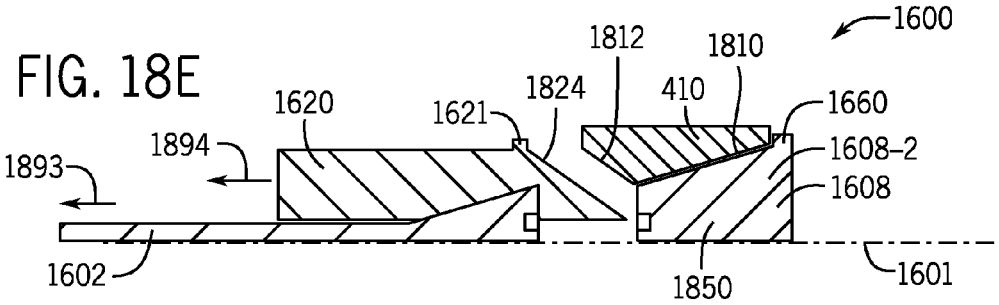
Figure 19E:
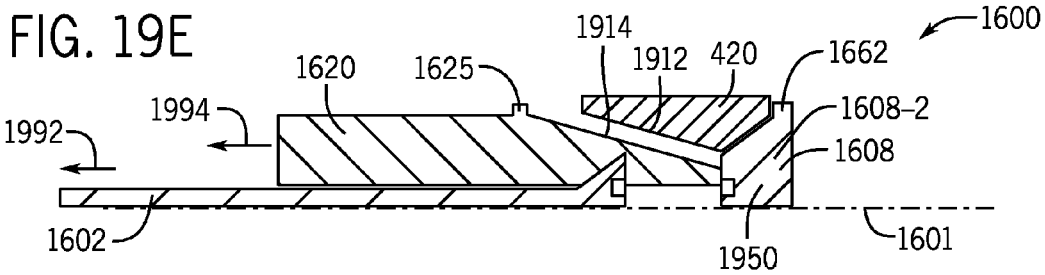
Figure 18F:
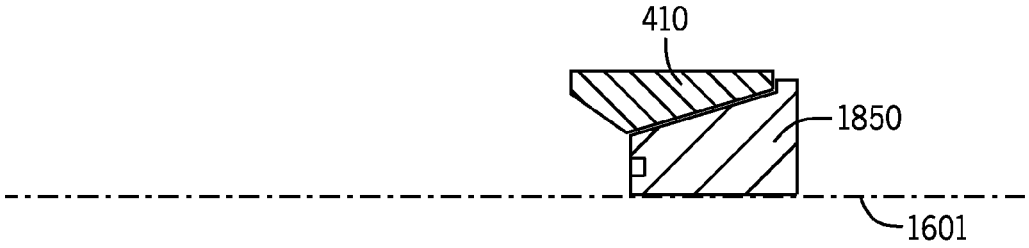
Figure 19F:
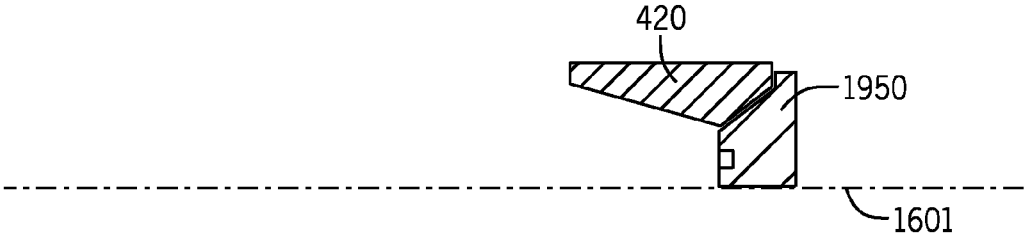
Figure 21A:
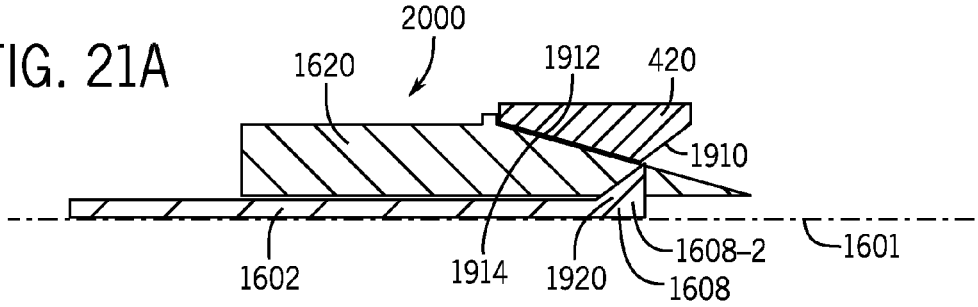
FIGS. 21A, 21B, 21C and 21D are cross-sectional views illustrating use of a setting tool to expand a lower segment of the seat assembly to transition the seat assembly to the expanded state according to a further example implementation.
Figure 21B:
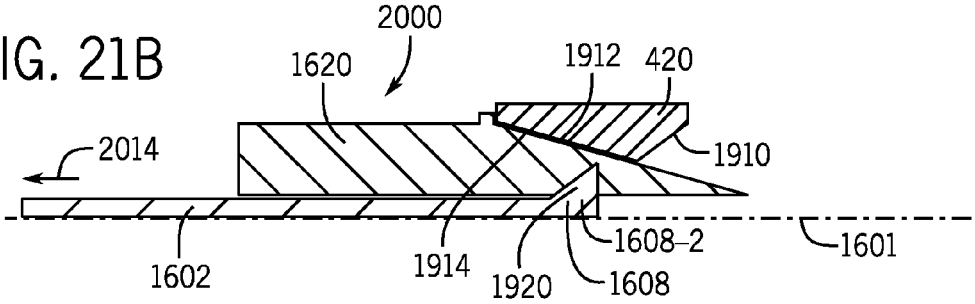
Figure 21C:
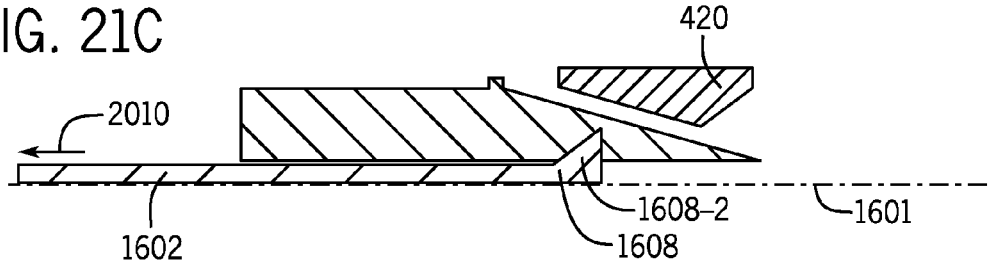

More specifically, FIGS. 18D and 19D depict separation of the compression member parts 1850 (FIG. 18D) and 1950 (FIG. 18E) from the rod 1602, thereby releasing the compression member from the rest of the setting tool, as illustrated in FIGS. 18E and 19E. As depicted in FIGS. 18F and 19F, after removal of the remainder of the setting tool 1600, the segments 410 (FIG. 18F) and 420 (FIG. 19F) and corresponding compression member parts 1850 and 1950 remain in the well. Thus, as illustrated in FIG. 18F, the compression piece 1850 stands alone with the upper segment 410; and the compression piece 1950 (see FIG. 19F) stands alone with the lower segment 420.

In accordance with some implementations, as discussed above, the segments 410 and/or 420 of the seat assembly may contain anchors, or slips, for purposes of engaging, for example, a tubing string wall to anchor, or secure, the seat assembly to the string.

In accordance with some implementations, the setting tool may contain a lower compression member on the rod, which serves to further expand radially the formed ring and further allow the ring to be transitioned from its expanded state back to its contracted state. Such an arrangement allows the seat assembly to be set at a particular location in the well, anchored to the location and expanded, a downhole operation to be performed at that location, and then permit the seat assembly to be retracted and moved to another location to repeat the process.

Figure 20A:
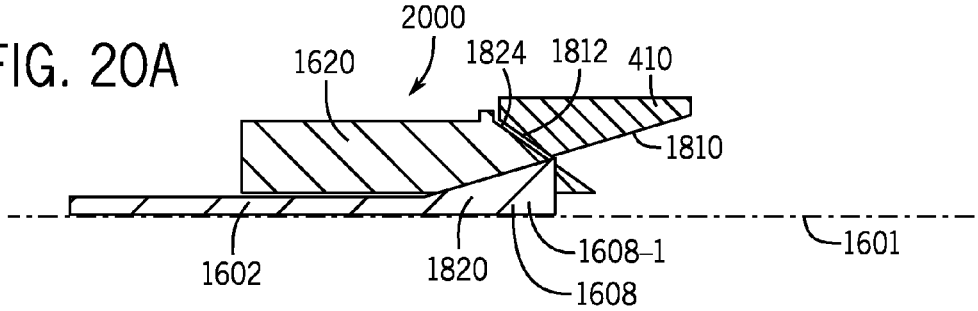
FIGS. 20A, 20B, 20C and 20D are cross-sectional views illustrating use of a setting tool to expand an upper segment of the seat assembly to transition the seat assembly to the expanded state according to a further example implementation.
Figure 20B:
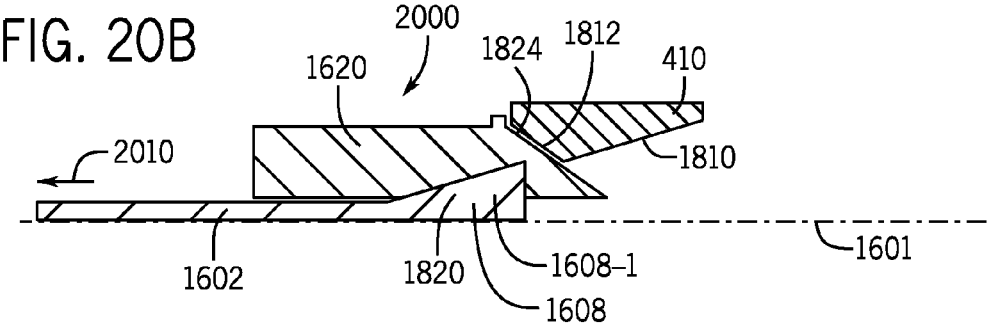
Figure 20C:
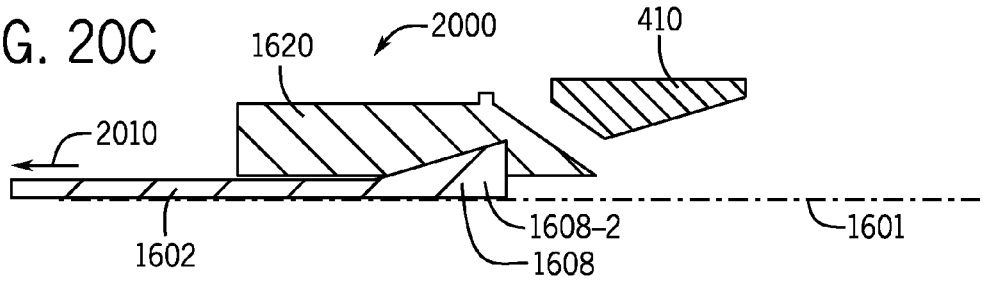
Figure 20D:
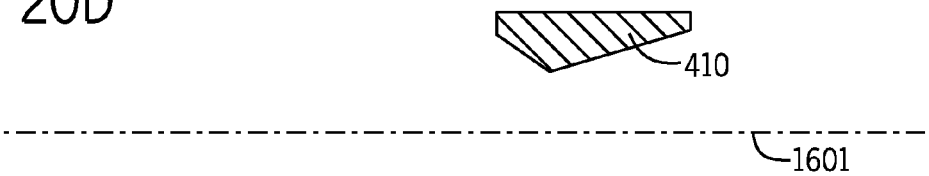
Figure 21D:
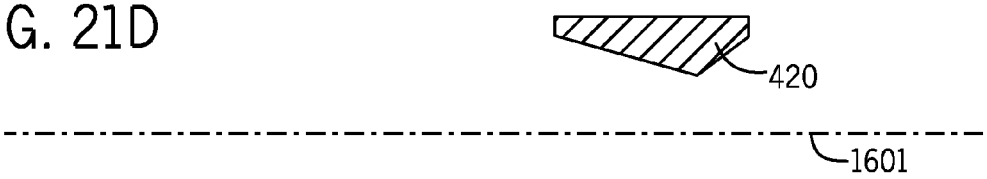

As a more specific example, FIGS. 20A, 20B, 20C and 20D depicts the actions of setting tool 2000 against the upper seat segment 410; and FIGS. 21A, 21B, 21C and 21D depict the actions of the setting tool 2000 against the lower seat segment 420. As shown, the setting tool 2000 does not have a lower compression member, thereby allowing the rod 1602 to be moved in a longitudinal direction (as illustrated by directions 210 of FIG. 20B and 2014 of FIG. 21B) to radially expand the segments 410 and 420 and leave the segments 410 and 420 in the well, as illustrated in FIGS. 20D and 21D.

Figure 22A:
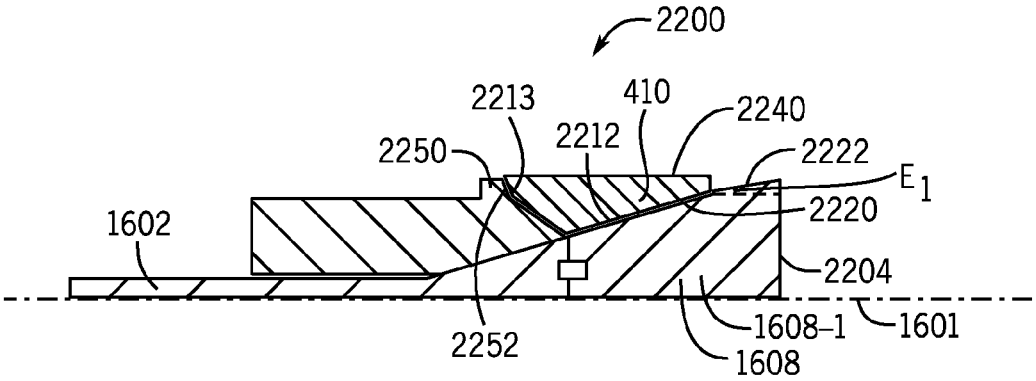
FIGS. 22A, 22B, 22C, 22D and 22E are cross-sectional views of a setting tool and a segmented seat assembly illustrating use of the setting tool to expand an upper segment of the seat assembly to transition the seat assembly to the expanded state according to a further example implementation.

FIG. 22A depicts a seat assembly setting tool 2200 according to further implementations. For these implementations, a mandrel 2201 of the tool 2200 includes the above-described inclined faces to contact seat assembly segments. The mandrel 2201 also contains an end sloped segment on its outer diameter to ease the radial expansion of the segments while having a small axial movement for purposes of reducing friction and providing easier sliding movement. In this manner, as depicted in FIG. 22A, the mandrel 2201 contains a portion 2250 that has an associated sloped surface 2252 that engages a corresponding sloped surface 2213 of the upper seat segment 410. The sloped surface 2252 forms an associated angle called "$\zeta 1$" with respect to the radial direction from the longitudinal axis 1601. Likewise, the portion 2250 may have a sloped surface that engages a corresponding sloped surface of the lower seat segment 420 and forms an angle (called "$\zeta 2$") with respect to the radial direction. The angles $\zeta 1$ and $\zeta 2$ may be equal to or steeper than the steepest of the $\alpha$ angles (the $\alpha 1$ and $\alpha 2$ angles) and the $\beta$ angles (the $\beta 1$ and $\beta 2$ angles), in accordance with some implementations.

On the other side of the seat segments, an additional sloped surface may be added, in accordance with example implementations, in a different radial orientation than the existing sloped surface with the angle $\alpha 1$ for the upper segment 410 and $\beta 1$ for the lower segment 420. Referring to FIG. 22A, the tool 2200 includes a lower compression piece 2204 that includes sloped surface 2220 having an angle $\delta 1$ with respect to the longitudinal axis 1601. The angle $\epsilon 1$ may be relatively shallow (a three to ten degree angle, for example, with respect to the longitudinal axis 1601) to obtain a self-locking contact between the upper seat segment 410 and the compression piece 2204. The upper seat segment 410 has sloped surfaces 2220 with the $\epsilon 1$ angle and a sloped surface 2280 with the $\alpha 1$ angle. In a similar manner, the lower seat segment 420 may have surfaces that are inclined at angles $\alpha 2$ and $\epsilon 2$. The $\epsilon 2$ angle may be relatively shallow, similar to the $\epsilon 1$ angle for purposes of obtaining a self-locking contact between the lower seat segment 420 and the compression piece.

Depending on the different slopes and angle configurations, some of the sloped surfaces may be combined into one surface. Thus, although the examples disclosed herein depict the surfaces as being separated, a combined surface due to an angular choice may be advantageous, in accordance with some implementations.

For the following example, the lower seat segment 420 is attached to, or integral with teeth, or slips, which engage the inner surface of the tubing string 20. The upper seat segment 410 may be attached to/integral with such slips, in accordance with further implementations and/or the seat segments 410 and 420 may be connected to slips; and so forth. Thus, many implementations are contemplated, which are with the scope of the appended claims.

Figure 22B:
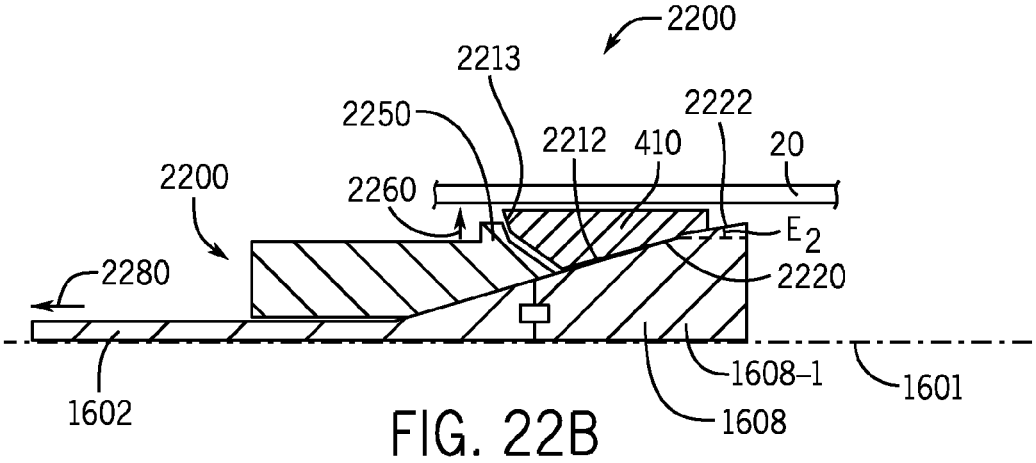
Figure 22C:
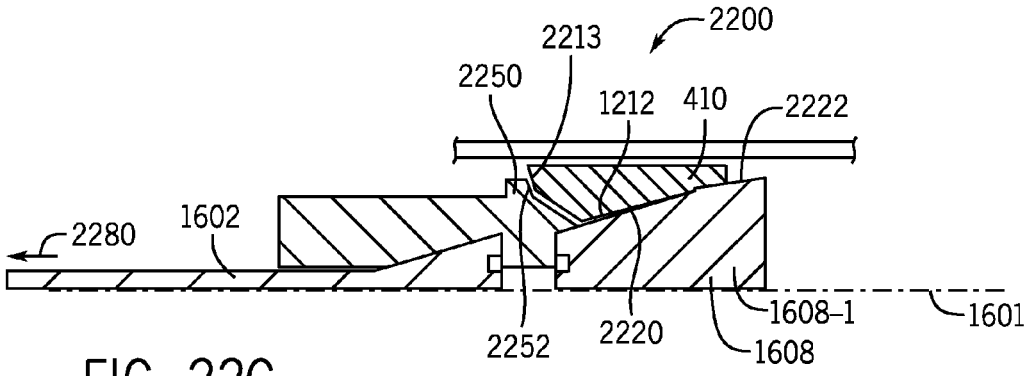

Due to the features of the rod and mandrel, the setting tool 2200 may operate as follows. As shown in FIG. 22B, upon movement of the rod 1602 along a direction 2280, the upper seat segment 410 radially expands due to a resultant force along a radial direction 2260. At this point, the rod 1602 and compression piece 2204 remain attached. The lower seat segment 420 radially expands as well, which causes the slips to engage the tubing string wall. Upon further movement of the rod 1602 in the direction 2280, the compression piece 2204 2204 separates from the remaining portion of the rod 1602, as illustrated in FIG. 22C. In a similar manner, this separation also occurs in connection with the lower seat segment 420.

Figure 22D:
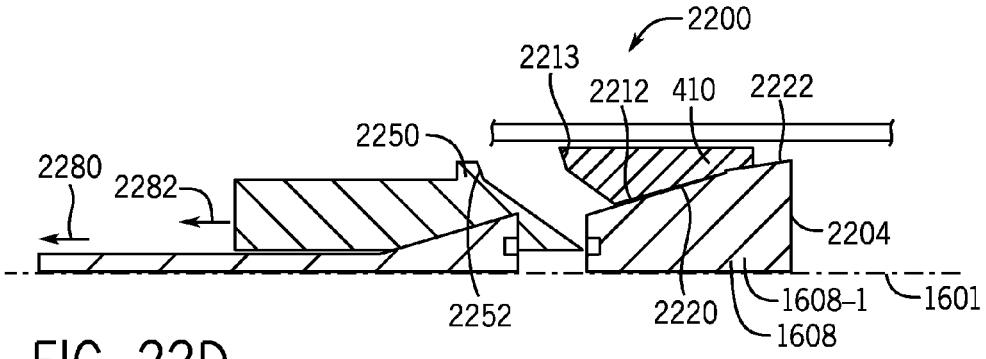
Figure 22E:
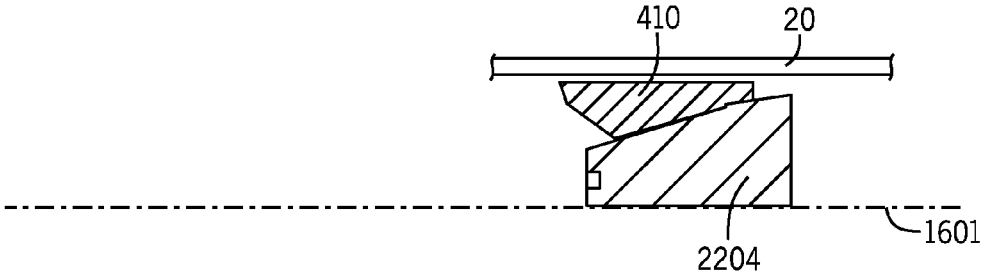

At this point, the segments are anchored, or otherwise attached to the tubing string wall, so that, as depicted in FIG. 22D, the remaining rod and mandrel may be further retracted uphole, thereby leaving the compression piece and segment down in the well, as further illustrated in FIG. 22E.

Other implementations are contemplated, which are within the scope of the appended claims. For example, in accordance with some implementations, the segmented seat assembly may be deployed inside an expandable tube so that radial expansion of the segmented seat assembly deforms the tube to secure the seat assembly in place. In further implementations, the segmented seat assembly may be deployed in an open hole and thus, may form an anchored connection to an uncased wellbore wall. For implementations in which the segmented seat assembly has the slip elements, such as slip elements, the slip elements may be secured to the lower seat segments, such as lower seat segments 420, so that the upper seat segments 410 may rest on the lower seat segments 420 after the untethered object has landed in the seat of the seat assembly.

In example implementations in which the compression piece(s) are not separated from the rod to form a permanently-set seat assembly, the rod may be moved back downhole to exert radial retraction and longitudinal expansion forces to return the seat assembly back into its contracted state.

Figure 23:
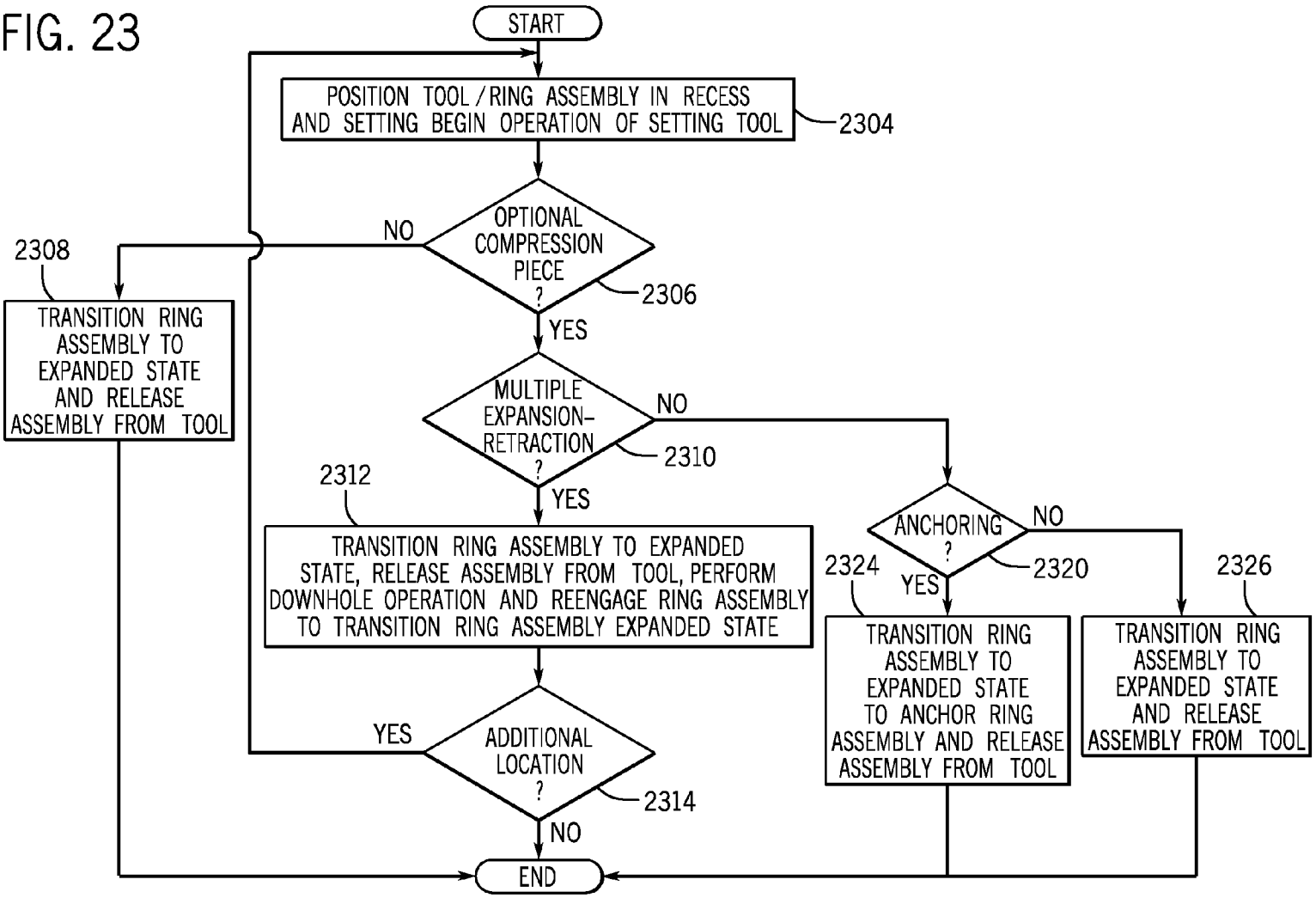
FIG. 23 is a flow diagram depicting a technique to use a setting tool to transition a segmented seat assembly between contracted and expanded states according to example implementations.

Thus, in general, a technique 2300 that is depicted in FIG. 23 may be performed in a well using a setting tool and a segmented seat assembly. Pursuant to the technique 2300, a tool and seat assembly is positioned in a recess of a tubing string (as an example) and movement of the tool is initiated, pursuant to block 2304. If the setting tool contains an optional compression piece (decision block 2306) and if multiple expansion and retraction is to be performed for purposes of performing multiple downhole operations (decision block 2310), then the technique 2300 includes transitioning the seat assembly to an expanded state, releasing the assembly from the tool, performing a downhole operation and then reengaging the seat assembly with the setting tool to transition the seat assembly back to the contracted state. If more downhole locations are to be performed (decision block 2314), then control transitions back to box 2304.

Otherwise, pursuant to the technique 2300, if the setting tool does not contain the compression piece (decision block 2306), then the technique 2300 includes transitioning the seat assembly to the expanded state and releasing the assembly from the tool, pursuant to block 2308. If the setting tool contains the compression piece but multiple expansions and retractions of the seat assembly is not to be used (decision block 2310), then use of the tool depends on whether anchoring (decision block 2320) is to be employed. In other words, if the seat assembly is to be permanently anchored, then the flow diagram 2300 includes transitioning the seat assembly to the expanded state to anchor the setting tool to the tubing string wall and releasing the assembly from the tool, thereby leaving the compression piece downhole with the seat assembly to form a permanent seat in the well. Otherwise, if anchoring is not to be employed, the technique 2300 includes transitioning the seat assembly to the expanded state and releasing the seat assembly from the tool, pursuant to block 2326, without separating the compression piece from the rod of the setting tool, pursuant to block 2326.

Figure 24A:
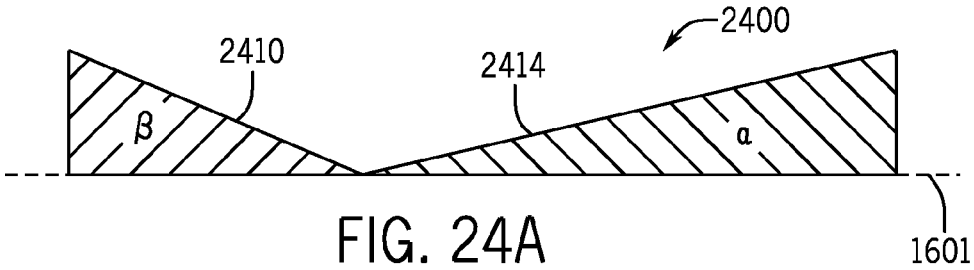
FIGS. 24A and 24B illustrate surfaces of the rod and mandrel of a seat assembly setting tool for a two layer seat assembly according to an example implementation.
Figure 24B:
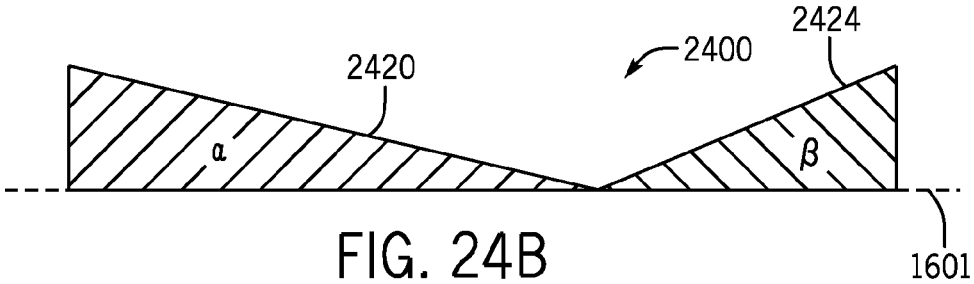
Figure 25A:
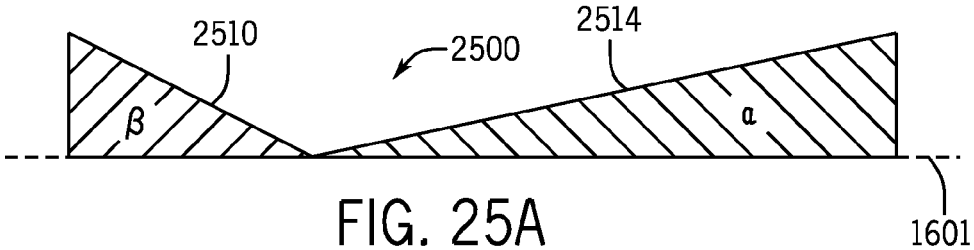
FIGS. 25A, 25B and 25C illustrate surfaces of the rod and mandrel of a seat assembly setting tool for a three layer seat assembly according to an example implementation.
Figure 25B:
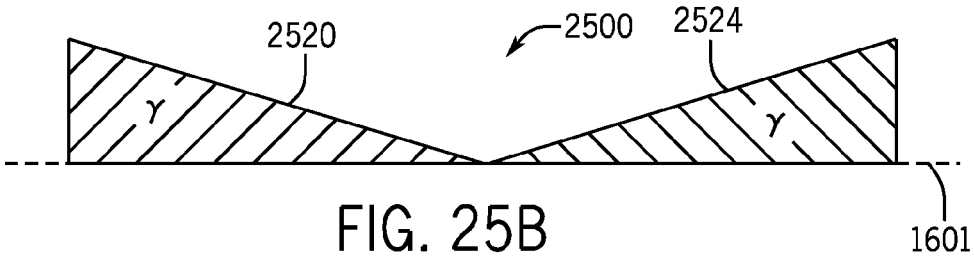
Figure 25C:
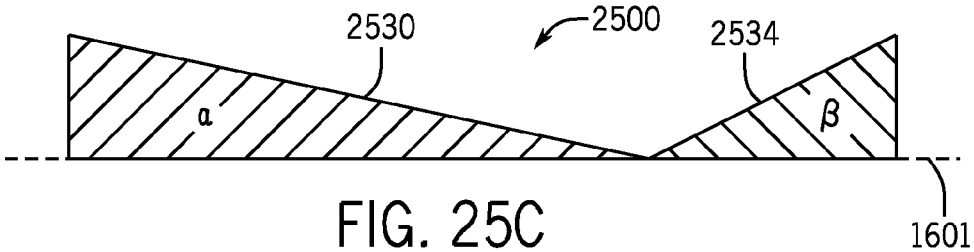
Figure 26A:
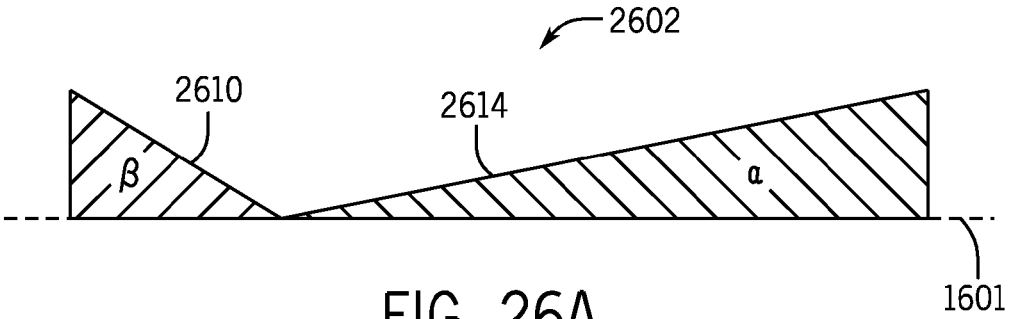
FIGS. 26A, 26B, 26C and 26D illustrate surfaces of the rod and mandrel of a seat assembly setting tool for a four layer seat assembly according to an example implementation.
Figure 26B:
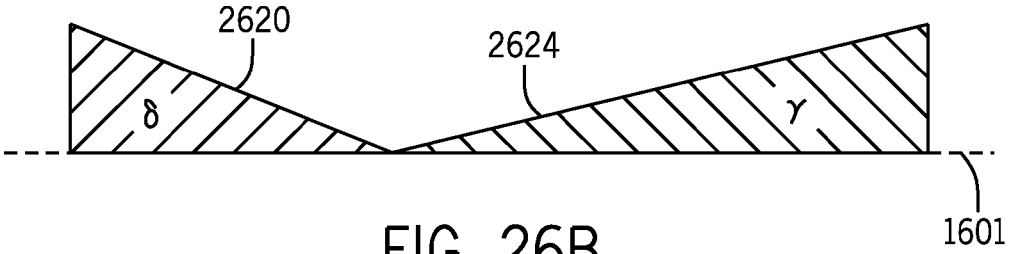
Figure 26C:
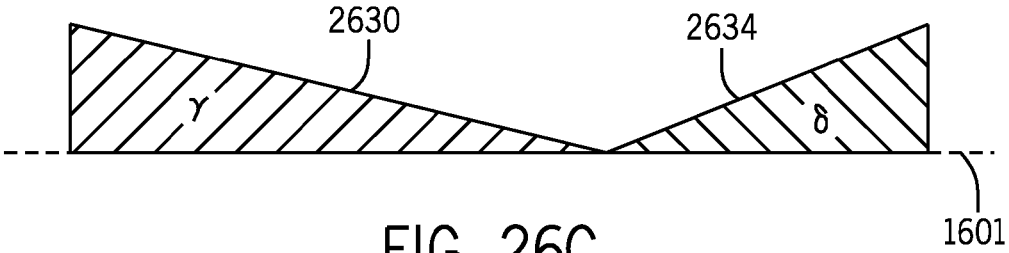
Figure 26D:
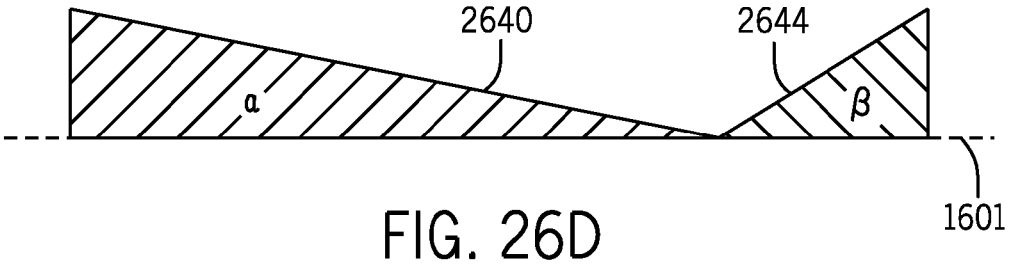

Many variations are contemplated, which are within the scope of the appended claims. For example, to generalize, implementations have been disclosed herein in which the segmented seat assembly has segments that are arranged in two axial layers in the contracted state of the assembly. The seat assembly may, however, have more than two layers for its segments in its contracted, in accordance with further implementations. Thus, in general, FIGS. 24A and 24B depict surfaces 2410 and 2414 (FIG. 24A) for an upper segment of a two layer seat assembly and corresponding surfaces 2420 and 2424 (FIG. 24B) for the lower segment of the two layer assembly. FIGS. 25A, 25B and 25C depict surfaces 2510 and 2514 (FIG. 25A), 2520 and 2524 (FIG. 25B), and 2530 and 2534 (FIG. 25C) for upper, intermediate and lower segments of a three layer seat assembly. FIG. 26A (showing layers 2610 and 2614), 26B (showing layers 2620 and 2624), 26C (showing layers 2630 and 2634) and 26D (showing layers 2640 and 2644) depict surfaces of the rod and mandrel for upper-to-lower segments of a four layer segmented seat assembly. Thus, many variations are contemplated, which are within the scope of the appended claims.

Figure 27A:
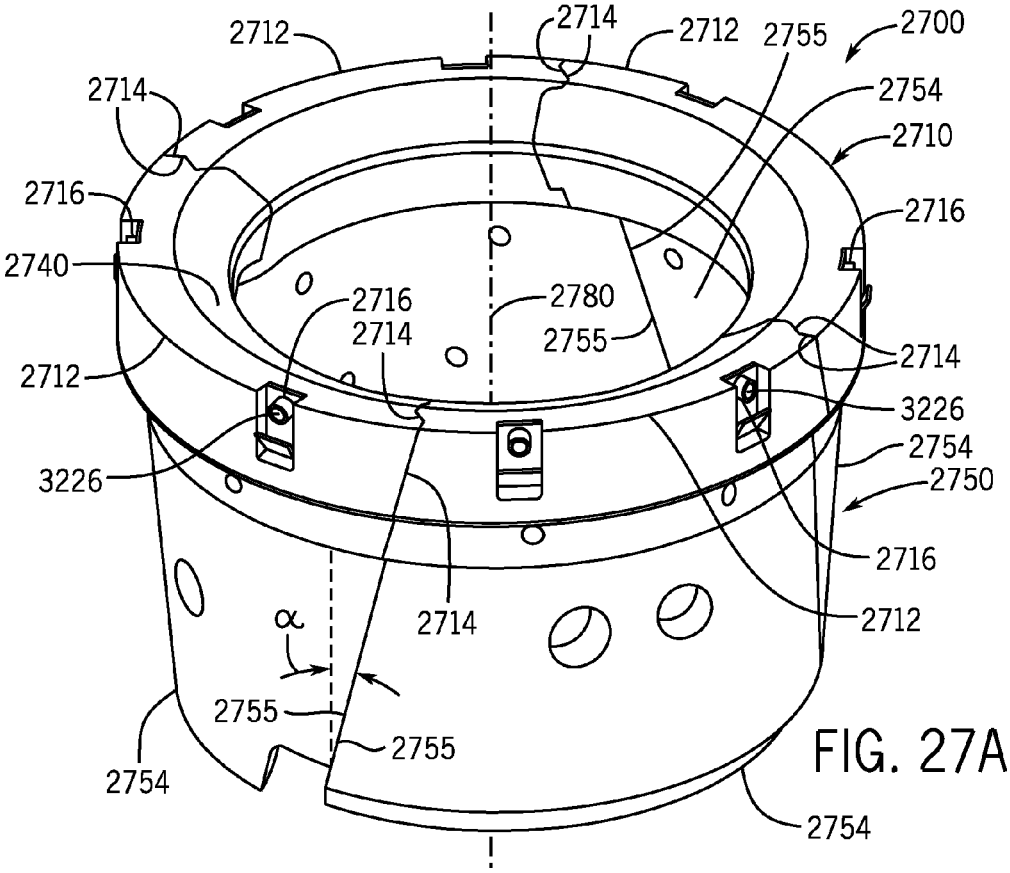
FIG. 27A is a perspective view of a segmented seat assembly according to an example implementation.

Referring to FIG. 27A, a segmented seat assembly 2700, in accordance with example implementations, includes an upper segmented subassembly 2710 and a lower segmented subassembly 2750. The segmented seat assembly 2700 is tubular; and the two subassemblies 2710 and 2750 circumscribe a longitudinal axis 2780. In general, the segmented seat assembly 2700 is constructed to be run into the well in a radially contracted state and thereafter be radially expanded (or "set") to form a continuous object-receiving seat, or ring. In this manner, when set, the upper segmented subassembly 2710 is constructed to be attached to a tubular member wall (a casing string wall or valve housing, as examples) to receive an object (not shown in FIG. 27A); and the lower segmented subassembly 2750 is constructed to be used to set, or form, the upper subassembly 2710 into the continuous ring.

After the segmented seat assembly 2700 is radially expanded to set the upper segmented seat subassembly 2710, the upper 2710 and lower 2750 subassemblies initially remain together. For example, the lower subassembly 2750 may rest on a profile formed in an inner wall of the tubular member. In further example implementations, the lower subassembly 2750 is held in position due to its attachment to the upper subassembly 2710. For example, the upper 2710 and lower 2750 subassemblies may be attached together via pins, screws, interlocking surfaces, and so forth. Regardless of the mechanism initiating holding the lower subassembly 2750 in place, however, in accordance with example implementations, the lower subassembly 2750 is constructed to eventually substantially disintegrate to allow the subassembly 2750 to separate from the upper subassembly 2710.

More specifically, in accordance with example implementations, the lower subassembly 2750 may be formed from one or more degradable materials, which degrade at relatively faster rate(s) than the material(s) that form the upper assembly 2710. This permits the relatively faster degradation of lower subassembly 2750 to allow the lower subassembly 2750 to separate from the upper subassembly 2710 and fall downhole in the well after the lower subassembly 2750 is used to set the upper subassembly 2710.

Because the upper subassembly 2710, which is dedicated to fluid barrier/diversion, is stressed at a relatively higher degree than the lower subassembly 2750, the subassemblies 2710 and 2750 may be formed from different materials that accommodate the different stresses as well as degrade at different rates. For example, in accordance with some implementations, the upper subassembly 2710 may be constructed from a material to hold the pressure differential during the barrier/fluid diversion. In this manner, in accordance with some implementations, the upper subassembly 2710 may be constructed from a relatively strong material (a magnesium alloy, aluminum, cast iron, or steel, as examples) or a differently-processed material with a coating or heat treatment or hipping to meet the stress requirement. As a further example, a sintered material may be used. In general, the material that is used for the upper subassembly 2710 may therefore be selected specific to the environment in which it is placed. The characteristics of the material include such characteristics as its rate of degradation (based on, for example, such well parameters as temperature, pressure, fluid type and the duration of the operation) and strength requirement (based on, for example, the isolation pressure). Although these material(s) may generally be degradable, the material(s) may have substantial compression or tensile strength abilities. In contrast, in accordance with example implementations, the bottom subassembly 2750 may be constructed from relatively weaker material(s).

In further implementations, the upper subassembly 2710 may be constructed from a relatively high strength material, such as aluminum, cast iron or steel, which may not be intended to dissolve; and as such the upper subassembly may be constructed to remain inside the tubing string permanently. For these implementations, the upper subassembly 2710 may still be removed, however, by collapsing, milling or through the use of an acid spot treatment, as examples.

As mentioned above, the bottom subassembly 2750 may be constructed from one or more dissolvable, or degradable materials. The material(s) of the lower subassembly 2750 may include one or multiple metallic materials and/or one or multiple non-metallic materials, depending on the particular example implementation. In accordance with some example implementations, the material(s) that are selected for the lower subassembly 2750 are constructed to last a few hours (two to twenty-four hours, as an example) inside the well for purposes of allowing the lower subassembly 2750 to perform its function of facilitating the setting the upper subassembly 2710. In general, the material(s) that are used to form the lower subassembly 2750 may include relatively weak material(s) that may are degraded, collapsed or disposed in order to avoid blocking passages inside the wellbore.

As more specific examples, the lower subassembly 2750 may be formed from one or more dissolvable, or degradable, alloys similar to or the same as the alloys that are disclosed in the following patents: U.S. Pat. No. 7,775,279, entitled, "DEBRIS-FREE PERFORATING APPARATUS AND TECHNIQUE," which issued on Aug. 17, 2010; and U.S. Pat. No. 8,211,247, entitled, "DEGRADABLE COMPOSITIONS, APPARATUS COMPOSITIONS COMPRISING SAME, AND METHOD OF USE," which issued on Jul. 3, 2012.

Figure 27B:
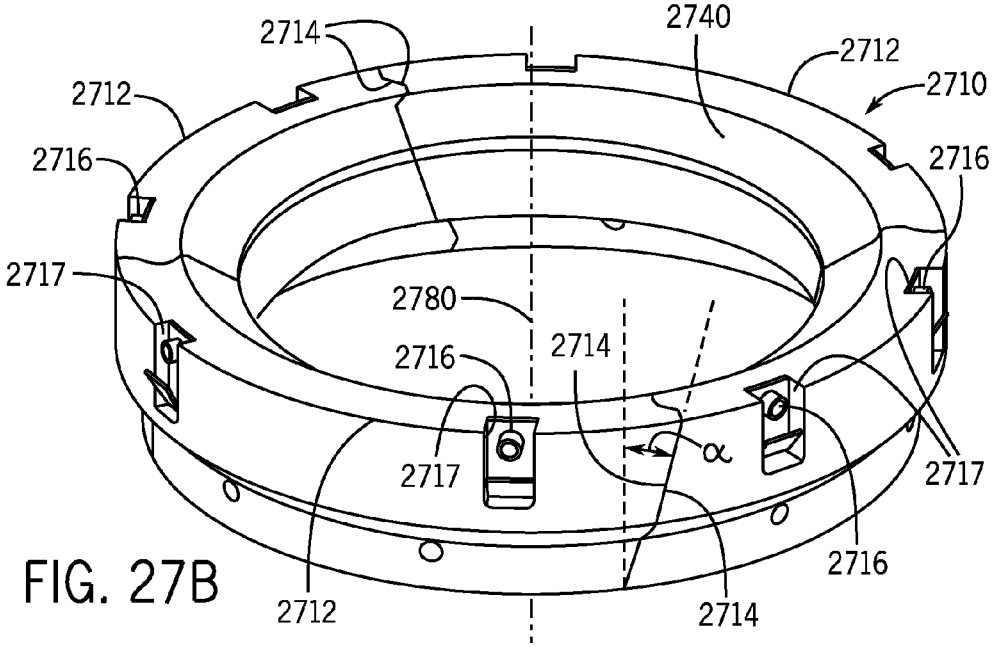
FIG. 27B is a perspective view of an upper segmented subassembly of the seat assembly of FIG. 27A according to an example implementation.
Figure 28A:
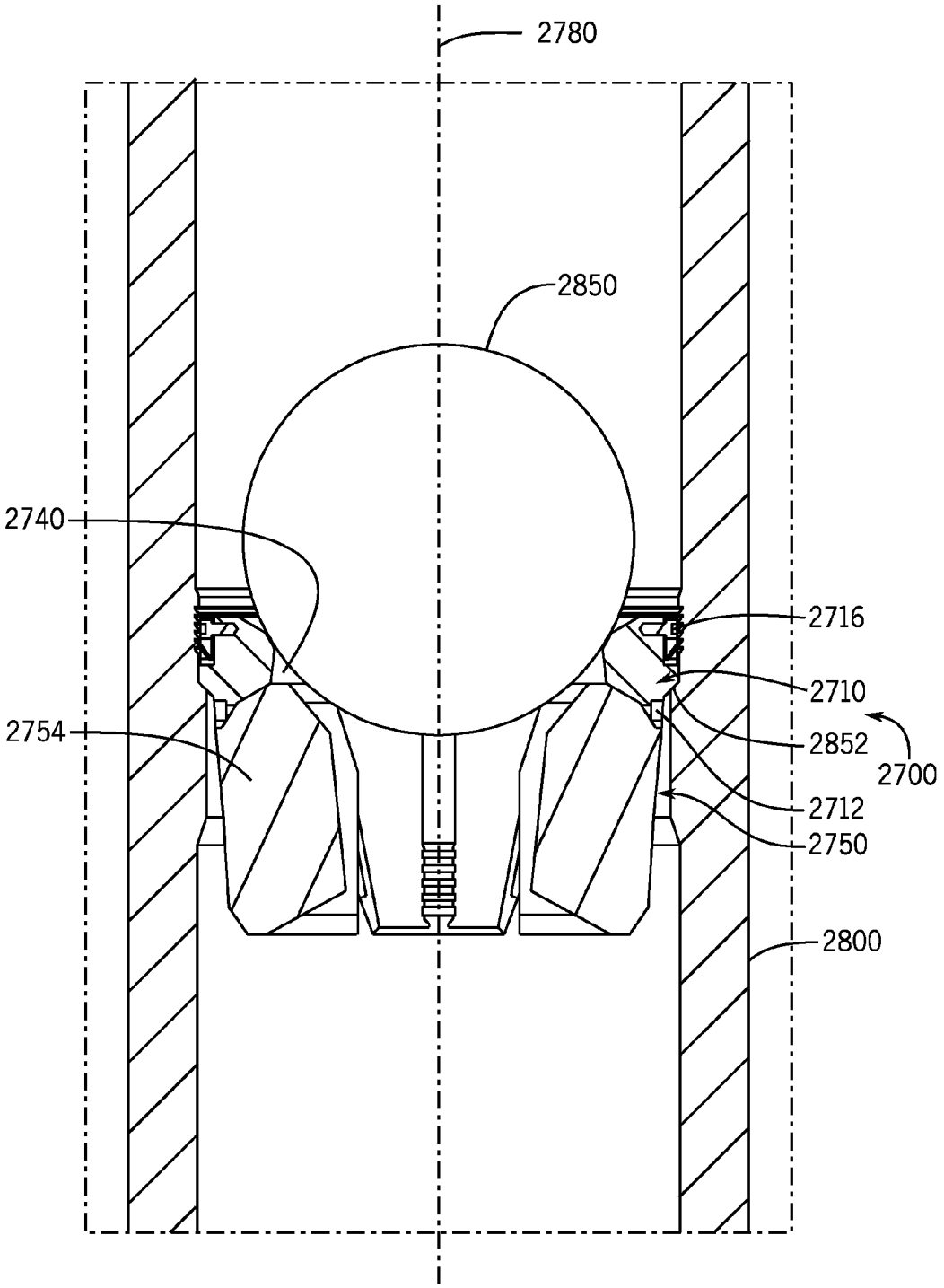
FIG. 28A is a schematic cross-sectional diagram illustrating the segmented seat assembly after being expanded and secured to a tubing string and after an activation ball has been landed in the seat assembly according to an example implementation.

Referring to FIG. 27B, in accordance with example implementations, the upper subassembly 2710 includes arcuate segments 2712 that, when the upper subassembly 2710 is set (i.e., the upper subassembly 2710 is fully radially expanded and secured to the tubular member) are constructed to form a continuous ring that has a corresponding seat 2740 to receive an object, such as an activation ball, dart, or a section of a tool string (a wireline, slickline or coiled tubing-conveyed tool or a pumped down tool, as examples) that is shown as an example in FIG. 28A for purposes of forming a fluid barrier.

As further illustrated in FIG. 27B, adjacent segments 2712 have mating inclined faces 2714. In this manner, in accordance with some implementations, a given end face 2714 may be inclined at an angle $\alpha$ with respect to the longitudinal axis 2780 of the seat assembly 2700. The inclined faces 2714, in turn, produce forces to radially expand the upper subassembly 2710 in response to interaction of the seat assembly 2700 with a tool, such as setting tool 1600 that is discussed above. The lower subassembly 2750 also includes segments 2754 that have corresponding inclined forces 2755 (see FIG. 27A). In this manner, as shown in FIG. 27A, in accordance with some example implementations, the lower subassembly 2750 includes segments 2754 that are disposed around the longitudinal axis 2780 and have corresponding inclined adjacent faces to promote the radial expansion of the lower subassembly 2750. As the lower subassembly 2750 expands, this in turn, produces corresponding radial expansion forces on the upper subassembly 2710.

Referring back to FIG. 27B, in accordance with some implementations, the upper subassembly 2710 includes latches 2716, which may be distributed about the outer periphery of the subassembly 2710 for purposes of securing the upper subassembly 2710 to the wall of the tubing string (a casing string, for example) such that the subassembly 2710 remains in place in its radially expanded state, after the lower subassembly 2750 has dissolved, or sufficiently disintegrated, and fallen away from the set, upper subassembly 2710.

Figure 28B:
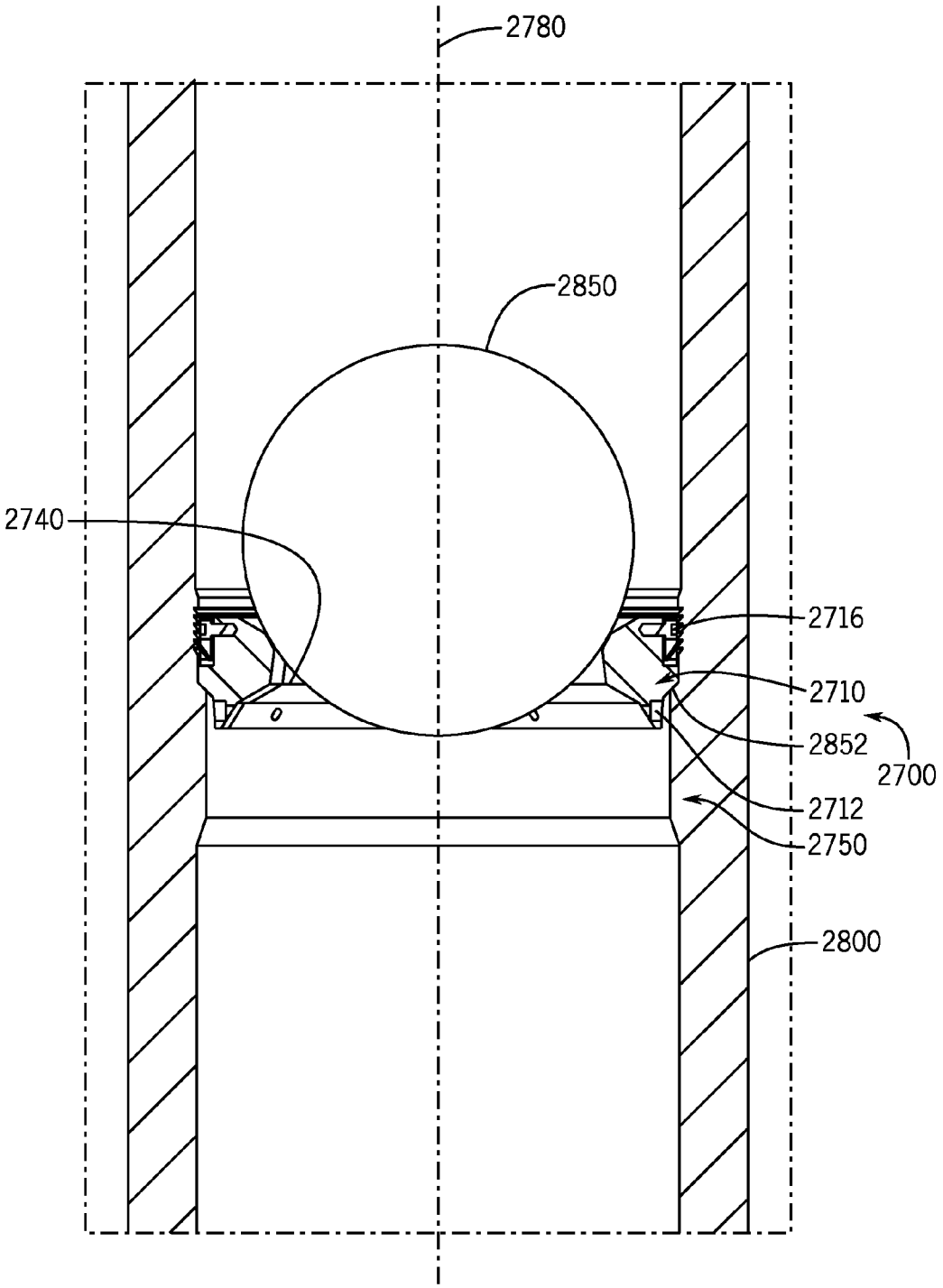
FIG. 28B is a cross-sectional schematic view showing the seat assembly and activation ball of FIG. 28A after removal of the lower segmented subassembly according to an example implementation

Referring to FIG. 28A, in accordance with some implementations, the upper subassembly 2710 may rest on a corresponding profile 2852 of a tubing string 2800 (a casing string, a fracturing sleeve valve, housing and so forth). After a tool is used to expand and set the upper seat assembly 2710, an object, such as the activation ball 2850 (or other object, as noted above), may be deployed and landed on the seat 2740 of the upper subassembly 2710. By applying fluid pressure (via pumping fluid into the well, for example) on the activation ball 2850, a downward force is created on the ball 2850 to form a corresponding metal-to-metal seal between the outer surface of the ball 2850 and the seat 2740. At this point, the lower subassembly 2750 is no longer needed, and due to the different disintegration rates of the materials used to form the upper 2710 and lower 2750 subassemblies, the lower subassembly 2750 degrades/dissolves/oxidizes, leaving the upper subassembly 2710 in the well, as depicted in FIG. 28B.

In accordance with example implementations, the dissolving material may contain one or more components that interact with other components. For example, in accordance with an example implementation, the untethered object 2850 may contain a chemical which, when the object 2850 dissolves, reacts with remaining components inside the well, such as the upper seat assembly 2710, for example. This additional chemical may be embedded or encapsulated inside the untethered object 2850 and may be released after a time delay (a time delay from a few hours to a few days, as an example) around the seat in the well. The chemical may, as an example, act as an accelerator or inhibitor to speed up or slow down the dissolving reaction of other components, such as the upper seat assembly 2710. The additional chemical may take the form of a pH modifier, a free-radical modifier, a temperature modifier (promoting an exothermic or an endothermic reaction, as examples), a viscosity modifier, and so forth, depending on the particular implementation.

Figure 29:
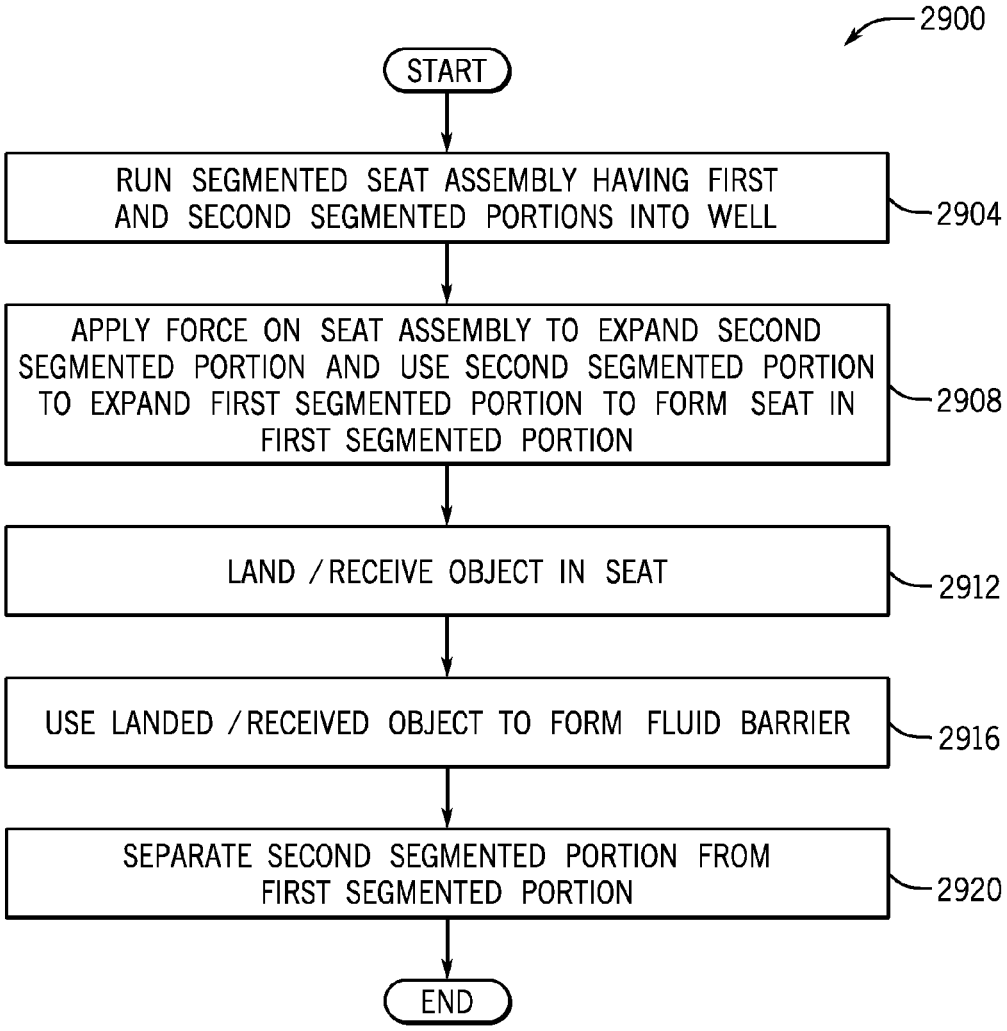
FIGS. 29 and 33 are flow diagrams depicting techniques to deploy and use segmented seat assemblies according to example implementations.

Referring to FIG. 29, thus, in accordance with example implementations, a technique 2900 includes running (block 2904) a segmented seat assembly having first and second segmented portions into a well and applying (block 2908) force(s) on the seat assembly to expand the second segmented portion and use the second segmented portion to expand the first segmented portion to form a seat in the first segmented portion. The technique 2900 further includes landing or receiving (block 2912) an object in the seat and using (block 2916) the landed/received object to form a fluid barrier. The technique 2900 further includes separating (block 2920) the second segmented portion from the first segmented portion. In accordance with example implementations, the technique 2900 may further include dissolving the object and/or first segmented portion (not necessarily at the same rate). Thus, many implementations are contemplated, which are within the scope of the appended claims.

Figure 30:
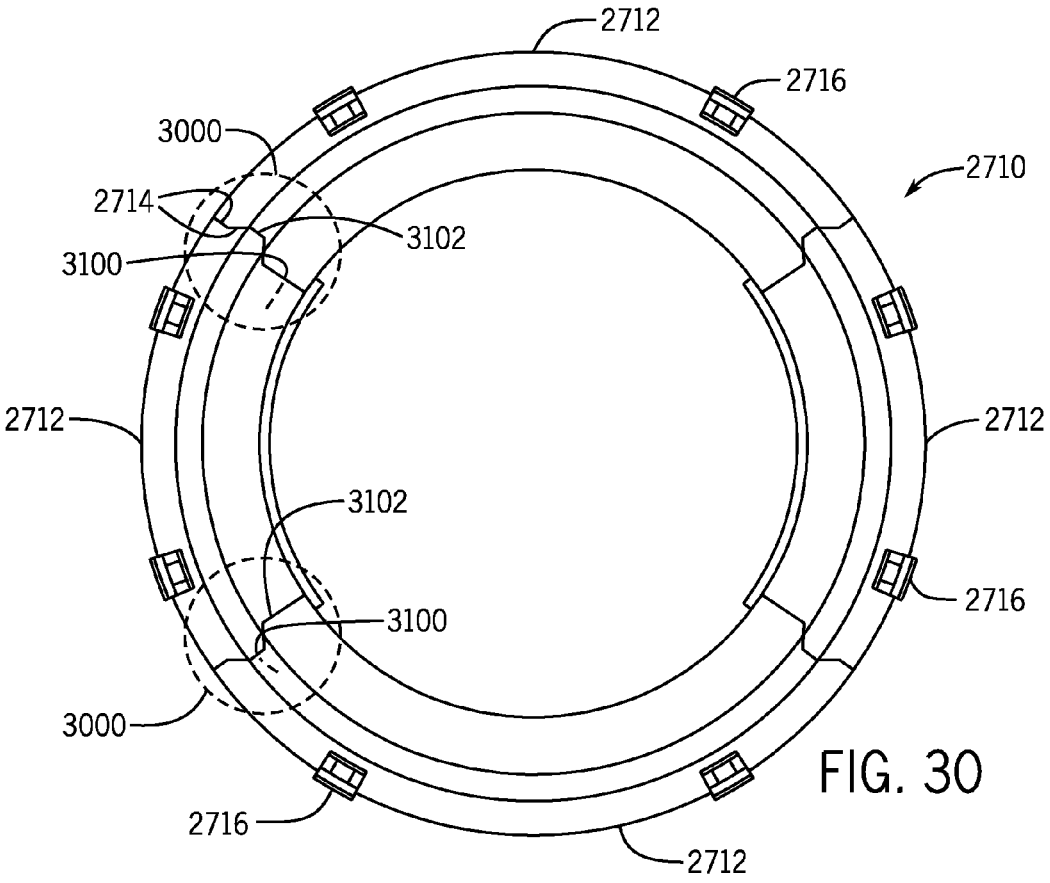
FIG. 30 is a top view of the upper segmented subassembly according to an example implementation.
Figure 31:
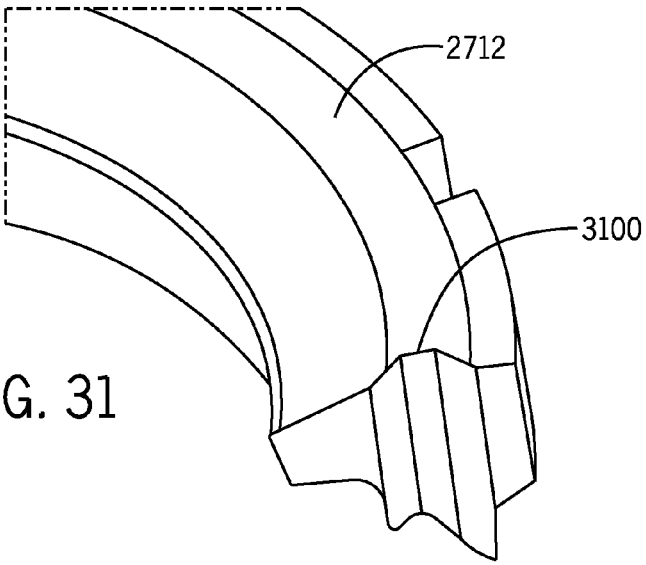
FIG. 31 is a perspective view of a segment of the upper segmented subassembly illustrating a side face of the segment according to an example implementation.

Referring to FIG. 30, in accordance with example implementations, the upper subassembly 2700 may include internal interlocking features 3000 that are formed between adjacent segments 2712 of the subassembly 2710. In accordance with some example implementations, the interlocking features 3000 may form a key and a groove "lock." Referring to FIG. 31 in conjunction with FIG. 30, as an example one side face 2714 of a particular segment 2712 may include, for example, a channel, or groove 3100, that forms a mating connection with a corresponding land, or key 3102 (see FIG. 30) of the side face 2714 of the adjacent and mating segment 2712.

Figure 32:
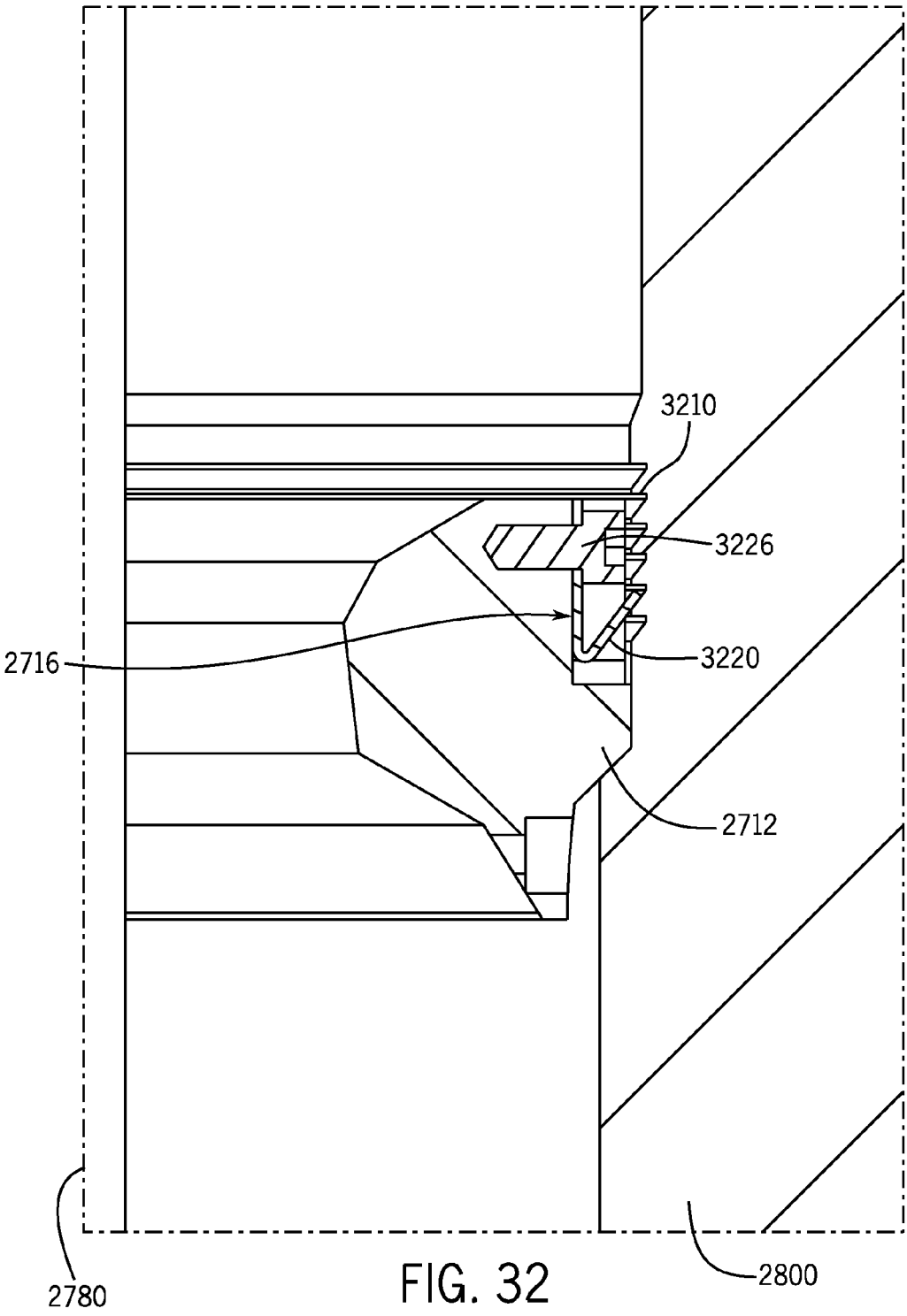
FIG. 32 is a schematic view of a latch assembly of the upper segmented subassembly and its engagement to ratchet teeth of a tubular member according to an example implementation.

Referring to a more detailed, partial cross-sectional view of FIG. 32, in accordance with example implementations, the latch 2716 may be formed from a spring 3220 that extends outwardly from the upper subassembly 2710 and is held in place by, for example, a corresponding pin 3226 that extends into the upper subassembly 3710. As shown in FIG. 32, in accordance with some implementations, the spring 3220 may extend outwardly at an outer end 3222 to engage a corresponding ratchet tooth profile 3210 that is formed on the inner wall surface of the tubing string 2800. Other mechanisms may be used to latch the upper subassembly 2710 to the tubular member 2800 in accordance with further example implementations. For example, in accordance with further example implementations, a snap ring may extend around the outer periphery of the upper subassembly 2710 and "snap" into an interior annular groove of the tubular member 2800 to secure the subassembly 2710 in place.

Figure 33:
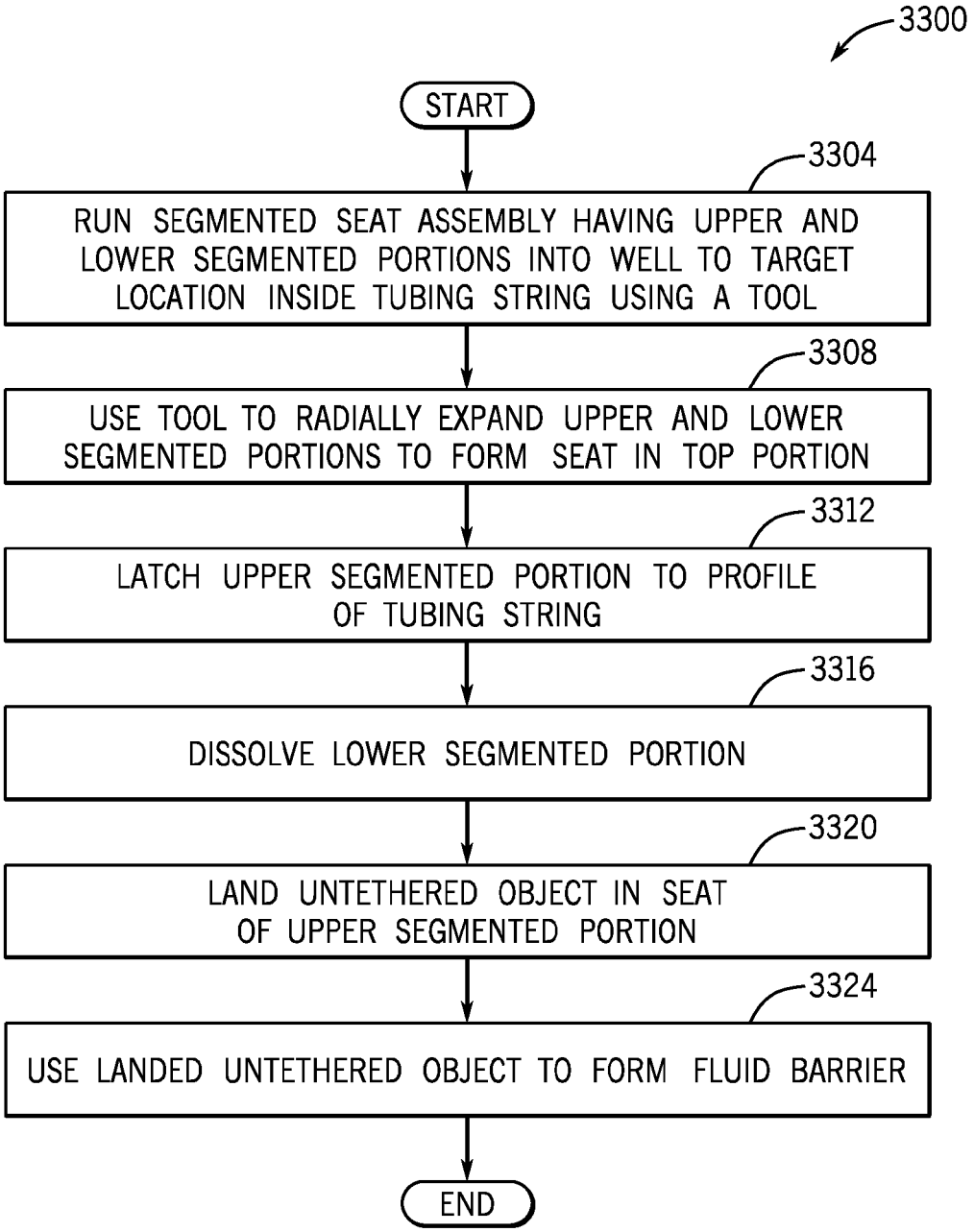
Figure 34:
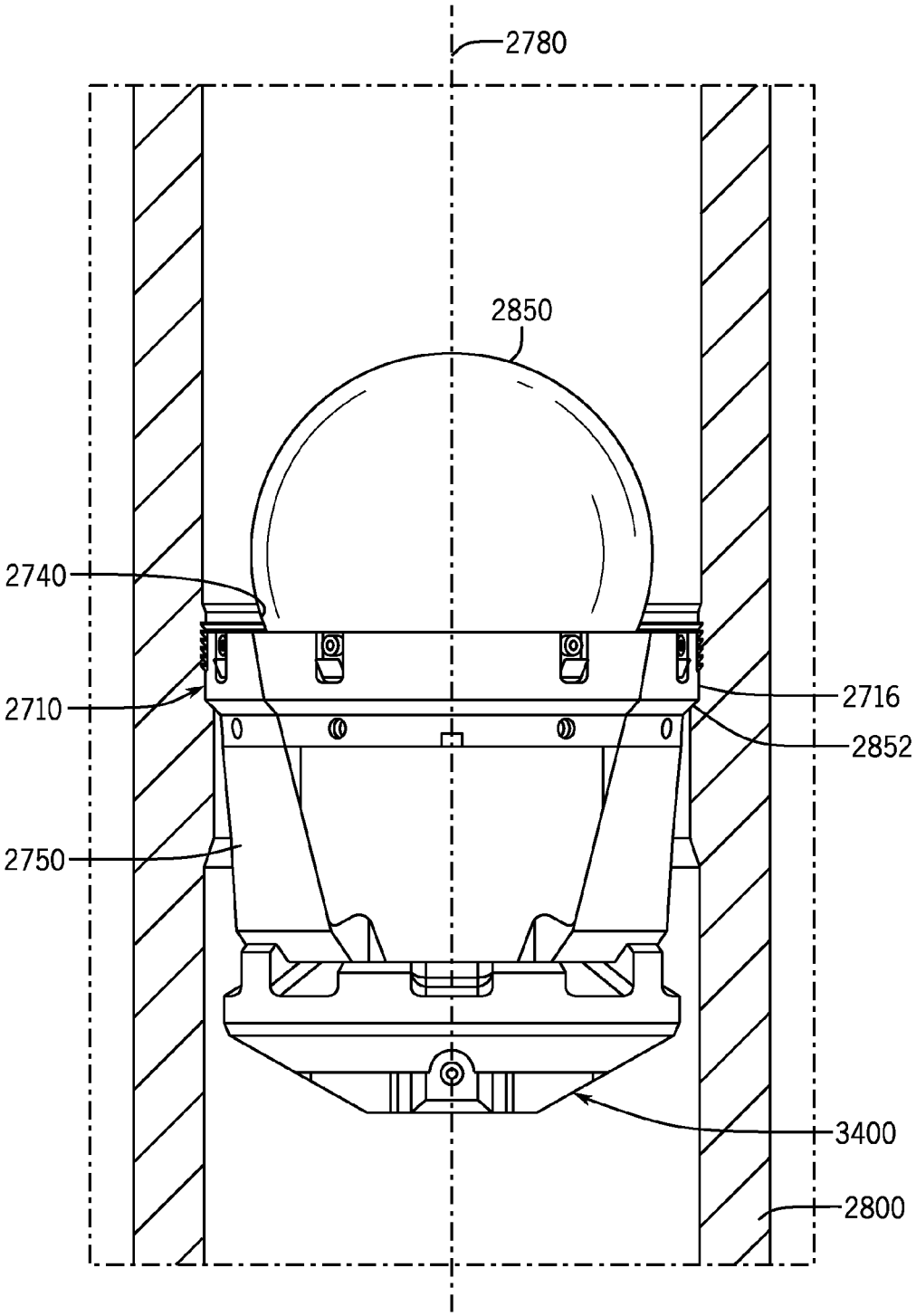
FIG. 34 is a perspective view of an activation ball, seat assembly and anchor according to an example implementation.

Thus, referring to FIG. 33, in accordance with example implementations, a technique 3300 includes running (block 3304) a segmented seat assembly having upper and lower segmented portions into a well to a target location inside a tubing string using a tool. Pursuant to the technique 3300, the tool may be used (block 3308) to radially expand the upper and lower segmented portions to form a seat in the top portion. Pursuant to the technique 3300, the upper segmented portion may be latched (block 3312) to a profile of the tubing string. The lower segmented portion of the assembly may then be dissolved, pursuant to block 3316 and an untethered object may be landed (block 3320) in the seat of the top portion. It is noted that blocks 3316 and 3320 may be performed in the opposite order than that depicted in FIG. 33, in accordance with further, example implementations. The landed untethered object may then be used to form a fluid barrier, pursuant to block 3324. In accordance with example implementations, the untethered object may dissolve. Moreover, in accordance with example implementations, the upper segmented portion of the assembly may dissolve; and, as noted above, the dissolving of the upper segmented portion may be dependent on or due to an interaction with the untethered object dissolving. Moreover, in accordance with further example implementations, the upper segmented portion may dissolve independently from the untethered object. Thus, many implementations are contemplated, which are within the scope of the appended claims. FIG. 34 depicts a perspective view of an assembly that includes an activation ball 2850, upper seat subassembly 2710, lower seat subassembly 2750 and an anchor 3400. The anchor 3400 may serve as a lower compression member to expand the subassemblies 2710 and 2750, similar to the lower compression members 1710, 1850 and 1950 that are discussed above. In accordance with example implementations, all three components 2710, 2750 and 3400 may be dissolvable, or degradable.

While a limited number of examples have been disclosed herein, those skilled in the art, having the benefit of this disclosure, will appreciate numerous modifications and variations therefrom. It is intended that the appended claims cover all such modifications and variations.

What is claimed is:

1. An apparatus usable with a well, comprising:

a first portion comprising a first plurality of segments; and a second portion comprising a second plurality of segments, wherein:

the apparatus is deployable in a tubing string installed in the well, the second plurality of segments is adapted to engage the tubing string and exert a force on the first plurality of segments, the first plurality of segments is adapted to, in response to the force exerted by the second plurality of segments, expand to form a seat in the tubing string to receive an untethered object, and the second plurality of segments is adapted to be released from the first plurality of segments downhole in the well.

2. The apparatus of claim 1, wherein the first and second plurality of segments are dissolvable.

3. The apparatus of claim 2, wherein the first and second plurality of segments are made of different materials.

4. The apparatus of claim 2, wherein the first and second plurality of segments have different rates of dissolution.

5. The apparatus of claim 4, wherein the second plurality of segments has a higher rate of dissolution than the first plurality of segments.

6. The apparatus of claim 1, wherein the top portion includes one or more features for engaging a tubular, a casing or a well bore wall.

7. The apparatus of claim 6, wherein at least one of the features comprises a ratchet.

8. The apparatus of claim 6, wherein the one or more features comprises a spring feature.

9. The apparatus of claim 6, wherein the one or more features comprise a plurality of teeth.

10. The apparatus of claim 6, wherein the one or more features are disposed on an outer diameter of the top portion.

11. The apparatus of claim 1, wherein adjacent segments of the first plurality of segments comprise interlocking engagement features.

12. The apparatus of claim 11, wherein the adjacent segments comprise a first adjacent segment and a second adjacent segment, the first adjacent segment comprises an engagement feature having angled notches located at an arcuate end which receives an angled extension of the second adjacent segment, and the angled extension is shaped to match the angled notch.

13. The apparatus of claim 11, wherein the engagement features comprise an arcuate feature.

14. The apparatus of claim 11, wherein the engagement features are configured to provide radial support to a ring seat formed by the top portion.

15. The apparatus of claim 1, wherein the first plurality of segments is adapted to form metal-to-metal fluid seals between adjacent segments of the first plurality of segments.

16. The apparatus of claim 1, wherein the apparatus comprises a component adapted to, in response to degradation of the component, release a chemical to promote degradation of another component of the apparatus.

17. The apparatus of claim 16, wherein the component adapted to release the chemical comprises the untethered object.

18. A method comprising:

deploying a seat assembly downhole, wherein the seat assembly comprises a top portion having a first plurality of segments and a bottom portion having a second plurality of segments;

setting the seat assembly so that the top portion of the seat assembly forms an annular seat, wherein setting the seat assembly comprises exerting a force due to engagement of the first plurality of segments with the second plurality of segments to radially expand the first plurality of segments to form the annular seat;

landing an untethered object on the annular seat; and releasing the bottom portion of the seat assembly while the untethered object is landed on the annular seat.

19. The method of claim 18, further comprising performing an operation once the untethered object is landed on the annular seat.

20. The method of claim 18, further comprising dissolving at least one of the untethered object and the top portion of the seat assembly.

21. The method of claim 18, further comprising engaging an interior wall of a tubing string, a casing, or a well bore with an outer surface of the top portion.

22. The method of claim 18, wherein one or more engagement features disposed on an outer diameter of the top portion engage the interior wall of a tubing string, a casing or a well bore.

23. The method of claim 18, further comprising supporting the annular seat with a plurality of support features disposed at arcuate ends of the first plurality of segments.

24. The method of claim 18, wherein releasing the bottom portion of the seat assembly comprises dissolving at least a portion of the bottom portion of the seat assembly.

25. The method of claim 18, further comprising:

releasing a chemical due to the untethered object degrading; and using the released chemical to promote degradation of another component of the seat assembly.

26. A system comprising:

a segmented seat assembly deployable downhole having a top set of segments and a bottom set of segments, wherein the bottom set of segments aid in radial expansion of the seat assembly and the top set of segments form a ring shaped seat upon full radial expansion; and an untethered object deployable downhole, wherein the untethered object is catchable by the ring shaped seat, wherein further the bottom set of segments dissolve at a rate higher than that of the top set of segments.

* * * * *